US005704332A

United States Patent [19]

Motakef

[11] Patent Number: 5,704,332

[45] Date of Patent: Jan. 6, 1998

[54] ROTARY ENGINE

[76] Inventor: Ardeshir Motakef, P.O. Box 395, Aberdeen, Ohio 45101

[21] Appl. No.: 622,825

[22] Filed: Mar. 27, 1996

[51] Int. Cl.[6] ..... F02B 53/00; F02B 75/26

[52] U.S. Cl. ..... 123/225; 123/56.7; 418/176; 418/243

[58] Field of Search ..... 123/225, 56.7; 418/243, 176

[56] References Cited

U.S. PATENT DOCUMENTS

| | | | |
|---|---|---|---|
| 1,015,663 | 1/1912 | Bonsteel | 123/225 |
| 1,088,391 | 2/1914 | Almy | 123/225 |
| 2,060,937 | 11/1936 | Hinckley et al. | 123/225 |
| 2,500,458 | 3/1950 | Hinckley | 123/225 |
| 2,762,346 | 9/1956 | White | 123/225 |
| 2,938,505 | 5/1960 | Quartier | 123/225 |
| 3,660,978 | 5/1972 | Hinckley | 123/225 |

*Primary Examiner*—Michael Koczo
*Attorney, Agent, or Firm*—Thompson Hine & Flory LLP

[57] ABSTRACT

An internal combustion engine in which linear, reciprocating motion of pistons is translated to rotary motion of a cylinder. In another embodiment, the pistons are in the form of V-shaped blades which bear against a camming surface to rotate an outer housing relative to an inner stator. Applications of this engine include use in tunnelling and well-drilling machines, pump motor for centrifugal and radial vane pumps, locomotives, marine propulsion, aircraft including piloted aircraft, and heavy machinery.

5 Claims, 36 Drawing Sheets

ROTARY ENGINE

BACKGROUND

The present invention relates to rotary engines and, more particularly, to rotary engines having a cylindrical stator portion which is concentric with a cylindrical rotor portion, and in which the combustion chamber is mounted on the stator portion.

Conventional internal combustion engines comprise an engine block having a plurality of cylinders formed therein. Each of these cylinders receives a piston having a piston rod which is connected to a crankshaft. A combustion chamber is formed within each cylinder by the piston, cylinder and cylinder head. Fuel air mixture is introduced into the combustion chamber and is ignited by a spark plug.

The resulting combustion of the fuel air mixture heats the air within the combustion chamber, causing it to expand rapidly against the surfaces defining the combustion chamber, and drive the piston downwardly. This downward motion rotates the associated crankshaft to deliver rotational force to a drive shaft.

Such engines typically are mounted within a vehicle which comprises a body, frame and wheels. Of course, in some environments, such as flying machines, the body includes wings, and the driveshaft is connected to a propeller.

While such designs are effective, they may be considered inefficient from the standpoint of the ratio of engine size to payload size. That is, the size of the engine is often small relative to the size of the payload area. Accordingly, there is a need for an internal combustion engine in which the payload volume is much larger in proportion to the engine volume than prior art internal combustion engine-propelled vehicles.

SUMMARY OF THE INVENTION

The present invention is a rotary engine in which the engine component is large in size compared to the payload carrying volume of the engine. In fact, the engine portion of the vehicle comprises a part of the vehicle housing, thereby resulting in efficiency of the design.

In the preferred embodiment of the invention, the rotary engine includes a central rotor having a peripheral cam surface with a plurality of radially extending noses. Each of the noses has a generally concave leading cam surface and a generally convex trailing surface. The central rotor includes a central output shaft which delivers torque to the drivewheels, propeller, or the like.

In such an embodiment of the invention, an annular stator is positioned radially outwardly of and concentric with the rotor. The stator has an annular wall and a plurality of V-shaped blades pivotally mounted in the wall. Each of the blades includes a radially inner plate having an end surface shaped to engage the cam surface, a radially outer plate, and a cylindrical pivot body positioned at a vertex of the blade. The annular wall includes a plurality of wedged shaped chambers positioned such that each of the chambers encloses one of the outer plates. The chamber includes an outer wall with an air inlet port and with a check valve in the port which prevents fluid flow out of the chamber, and a plurality of concave combustion surfaces, each of the combustion surfaces being positioned adjacent to one of the chambers and to one of the inner plates and including a spark plug. The body has passageways interconnecting the chambers and the combustion surfaces. The passageways include a valve oriented to prevent fluid flow from the inner plate to the outer plate.

The preferred embodiment includes an outer cylinder shaped to enclose the stator and rotor and pair of disc-shaped end plates mounted on the ends of opposing ends of the outer cylinder. One of the plates includes intake ports for supplying air and fuel mixture to the chamber.

In operation, rotation of the rotor relative to the stator as a result of the pivoting of the blades against the rotor, causes the cam surface of the rotor to bear against the ends of the V-shaped blades and pivot the blades relative to the stator, thereby causing the outer plate to compress a fuel air mixture in the chamber and force that mixture through the channels to a space between the inner plate and the combustion surface where the mixture is ignited by the spark plug, thereby forcing the blade to pivot against the convex trailing cam surface and rotate the rotor relative to the stator.

In an alternate embodiment of the invention, the rotary engine includes a central, annular stator having an annular wall and a plurality of V-shaped blades pivotally mounted within the wall, and an annular rotor oriented concentrically with the stator and positioned radially outwardly thereof, the rotor having a radially inner peripheral cam surface. The cam surface includes a plurality of radially inwardly extending noses, each of the noses having a generally convex leading cam surface and a generally concave trailing surface of a smaller radius of curvature. In all other respects, the engagement between the blades of the inner stator and the cam surface of the outer rotor are the same, including the action of the rotor when acted upon by the blades.

With such an embodiment, the outer rotor can comprise the outer wall of the engine, and thereby provide a means of propulsion by rotating against a fixed surface, such as the ground. In such embodiment, the central portion of the engine is vacant and is appropriately sized to carry a payload. In a large version of the engine, the payload may comprise a command center which would carry human occupants. In a smaller version, the payload could comprise computer control systems, cargo and the like.

Accordingly, it is an object of the present invention to provide a rotary engine having an annular stator which includes V-shaped plates which pivot in response to ignition of fuel air mixture, and a rotor which is acted upon by the pivoting blades to provide relative rotational movement.

In a second alternate embodiment of the invention, the rotary engine comprises a bowl having a cylindrical wall with an undulating upper edge forming a cam surface, a block, superposed to the bowl and having a plurality of cylinders formed therein, and a plurality of pistons mounted within the cylinders for movement parallel to a central axis of the bowl, each of the pistons having a rod terminating in a cam positioned to engage the cam surface of the bowl. Reciprocating movement of the pistons within the block relative to the bowl causes the cams associated with the pistons to bear against the cam surface and rotate the cylindrical wall and bowl relative to the block. This embodiment also includes a valve head attached to the block and having inlet and outlet exhaust ports which communicate with each of the cylinders. Inlet and exhaust valves are mounted for reciprocating movement within the ports.

With this embodiment, the rotary engine includes a central shaft which is mounted to the bowl and extends along a central axis of the engine. A disk-shaped top flange partially covers the valve block and is connected to the shaft so that the top flange shaft and bowl rotate as one relative to the block. In a preferred embodiment, the top flange includes downwardly projecting, arcuately-shaped cams which contact intake and exhaust valves mounted in the valve head. Accordingly, rotation of the top plate with the bowl causes the cams to contact the intake and exhaust valves sequentially, opening and closing them as appropriate to allow a fuel-air mixture to enter the cylinder, and combusted fuel-air mixture to be exhausted.

In a third alternate embodiment of the invention, the engine comprises a central cylindrical wall having an undulating upper edge forming a cam slot, and an outer peripheral flange, a block, superposed to the central cylindrical wall, having a plurality of cylinders formed therein and having inner and outer cylindrical walls oriented concentrically with respect to the central wall and positioned concentrically inside and outside a central wall, respectively. The outer cylindrical wall is seated on the flange of the central cylindrical wall. A plurality of pistons are mounted within the cylinders for movement in axial direction relative to the central cylindrical wall. The embodiment also includes a disk-shaped floor having an outer peripheral groove for receiving a lower periphery of the cylindrical wall and being attached to the inner cylindrical wall. Consequently, the floor remains fixed relative to the block and supports the central cylindrical wall for movement. In this embodiment, traction means or propulsion blades such as propellers for air or marine travel, can be attached to the central cylindrical wall, preferably at the flange. In this preferred embodiment, oil seals and bearings are positioned between the outer cylindrical wall and the flange, and the central cylindrical wall and the peripheral groove. The central cylindrical wall includes inner and outer concentric camming surfaces shaped to contact push rods which actuate intake and outlet valves communicating with the cylinders in the block.

Accordingly, it is a further object of the present invention to provide a rotary engine having a cylindrical wall or bowl having an upper undulating edge forming a camming surface or slot, and a fixed block containing a plurality of cylinders housing pistons which react against and rotate the cylindrical wall or bowl relative to the block; a rotary engine which is compact and can deliver a high horsepower output for its size; and a rotary engine which is relatively simple in construction.

Other objects and advantages will be apparent from the following description, the accompanying drawings and the appended claims.

DETAILED DESCRIPTION

Figure 1:
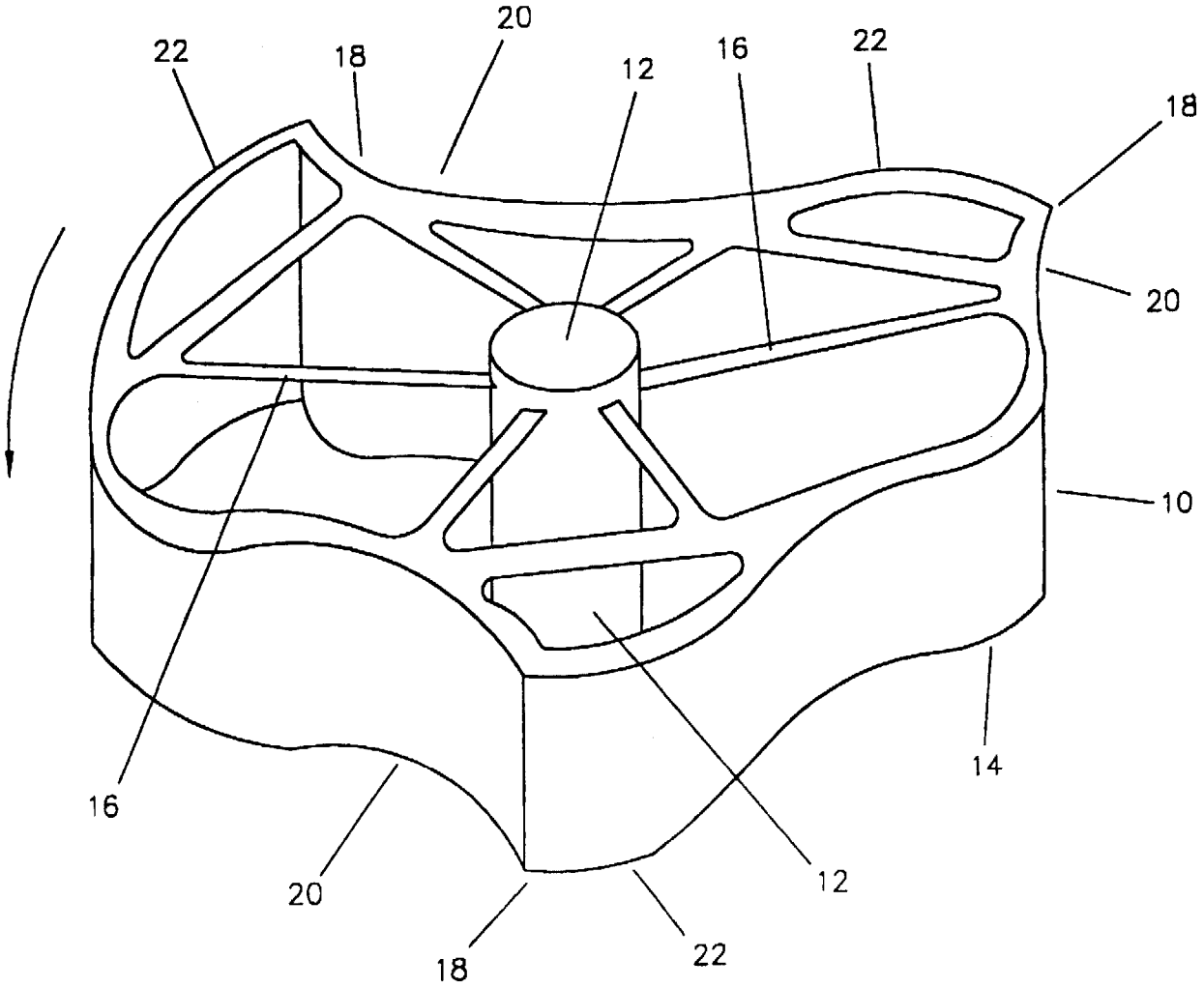
FIG. 1 is a perspective view of the rotor of the preferred embodiment of the rotary engine of the present invention.

As shown in FIG. 1, the rotary engine of the present invention includes a central rotor, generally designated 10, having a central shaft 12 and an outer camming surface 14. The outer camming surface 14 is connected to the central shaft 12 by a plurality of webs 16. The outer camming surface 14 includes three lobes or noses 18. Each of the noses 18 includes a convex leading surface 20 and a concave trailing surface 22.

Figure 2:
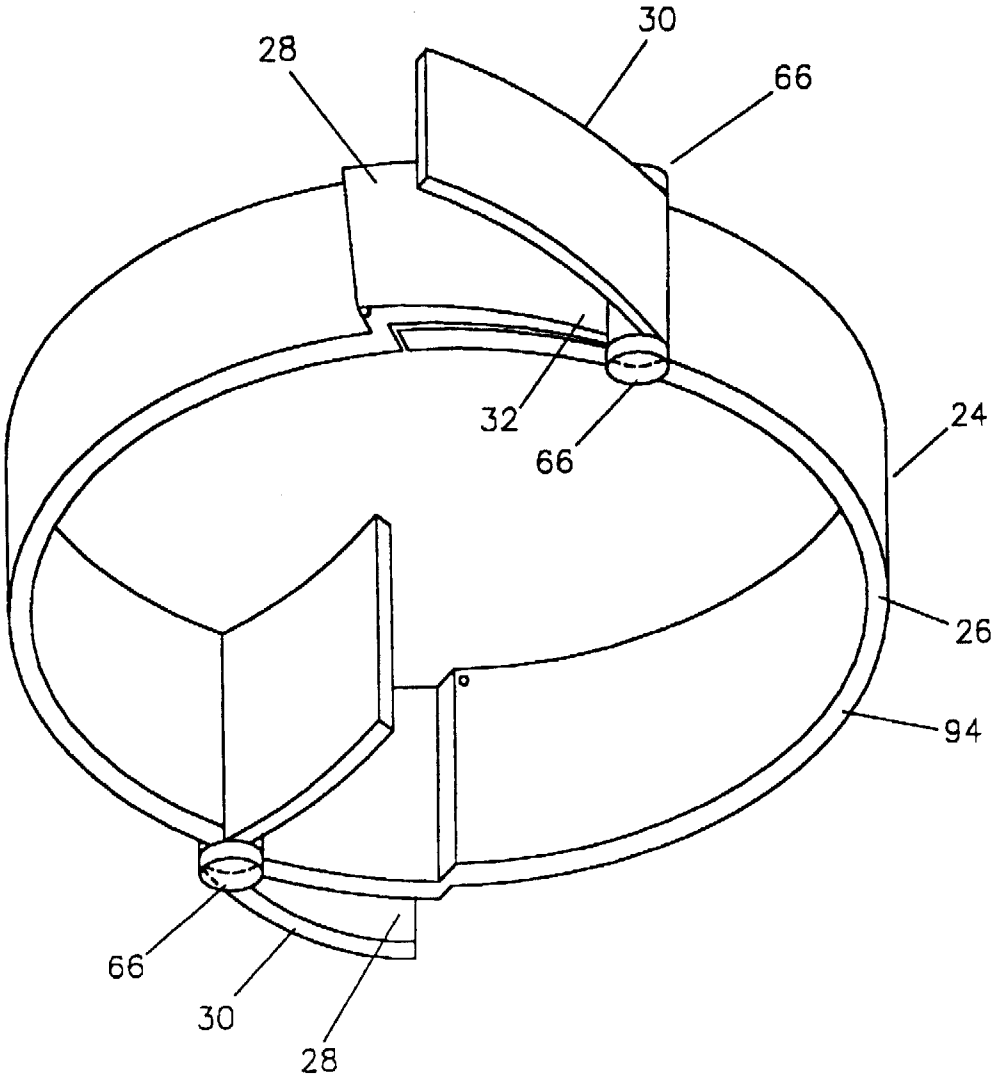
FIG. 2 is a perspective view of the stator of the preferred embodiment of the rotary engine of the present invention.

As shown in FIG. 2, a stator, generally designated 24, includes an annular wall 26 and a pair of opposing offset walls 28. The stator 24 includes a pair of opposing V-shaped blades, generally designated 30, which are pivotally mounted on the stator. Specifically, V-shaped blades 30 each include a cylindrical pivot body 32 (see also FIGS. 3 and 4), which, as shown in FIG. 6, is received within a cylindrical recess 34 formed in the stator 24.

Figure 6:
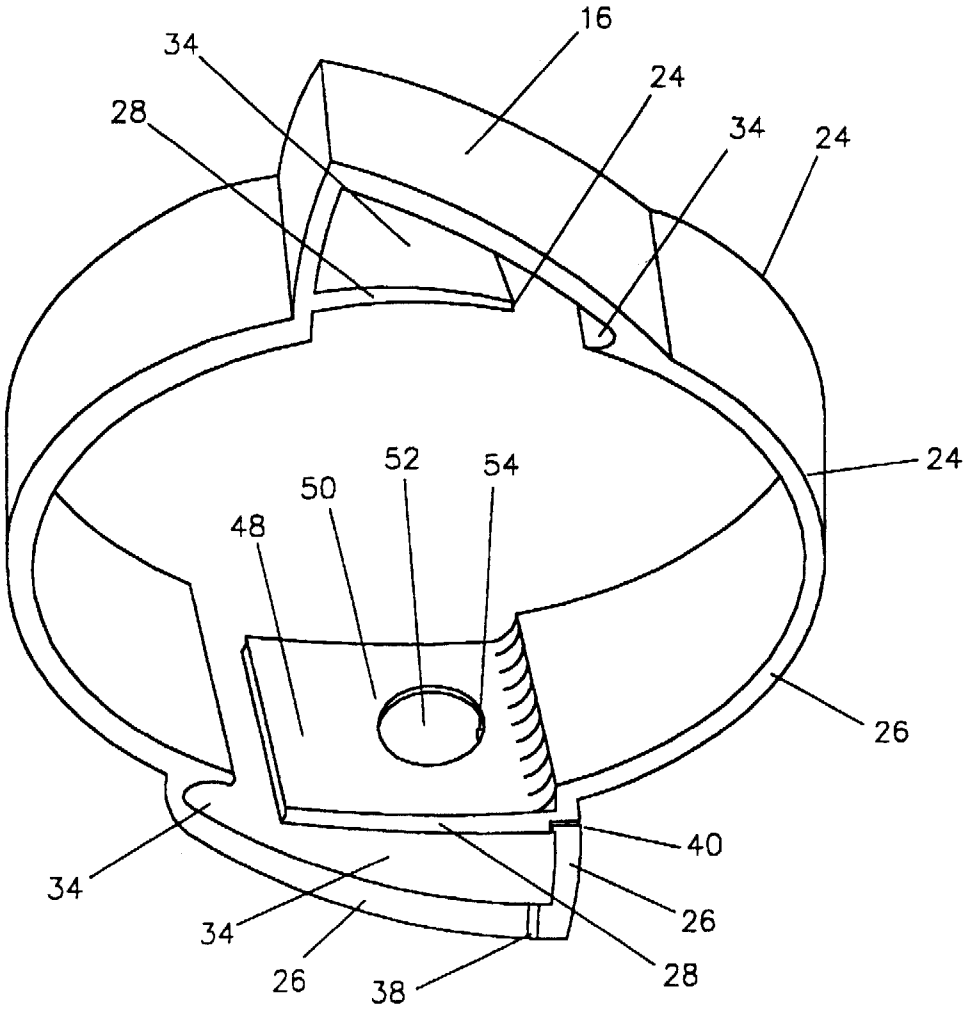
FIG. 6 is a perspective view of the stator of FIG. 2, shown without V-shaped blades.
Figure 7:
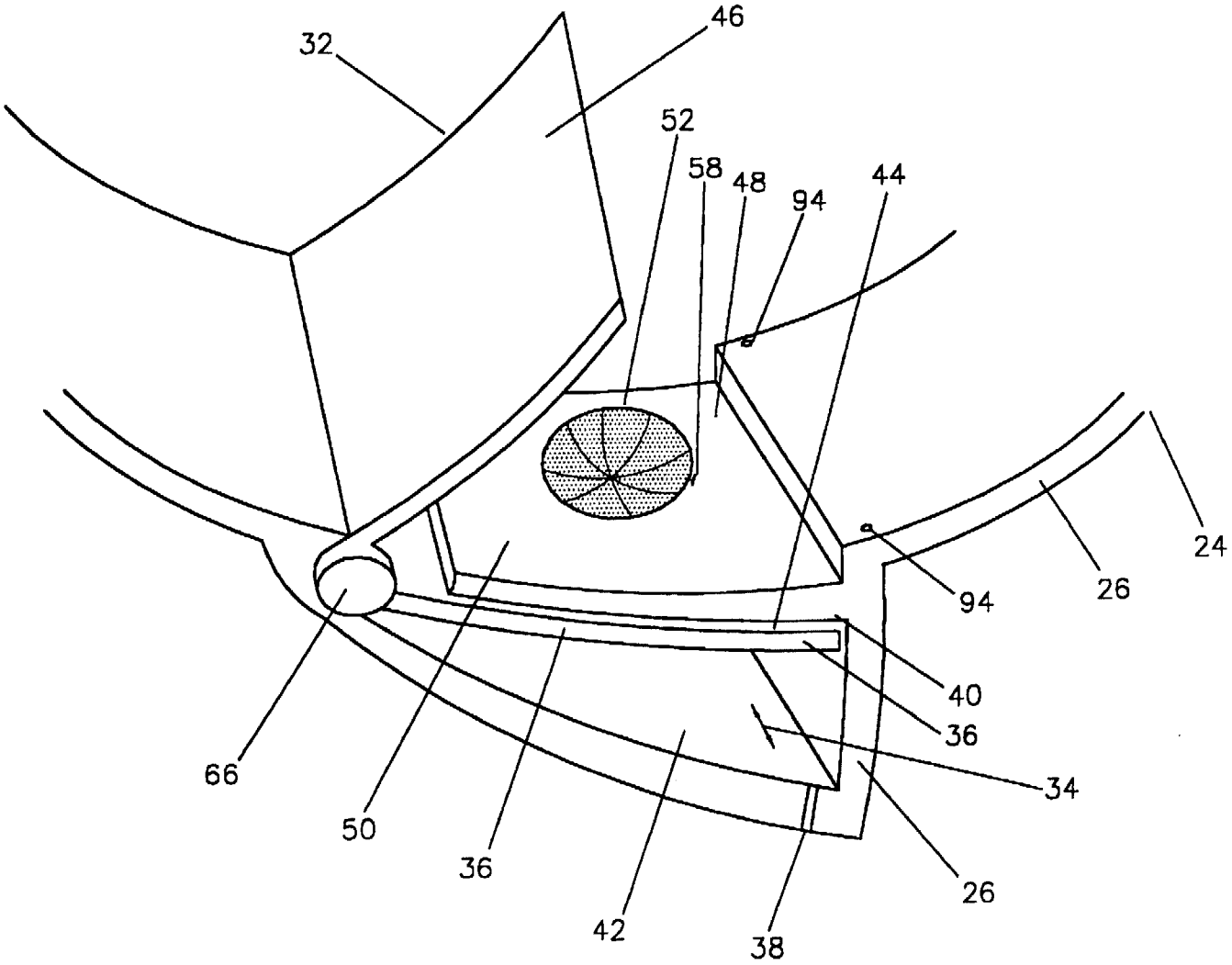
FIG. 7 is a detail perspective view of the stator of FIG. 2, showing a V-shaped blade.

As shown in FIGS. 6 and 7, the stator 24 includes a compression chamber 34, which is wedged-shaped and is integral with the stator. The compression chamber 34 is shaped to receive an outer plate 36 of the blade 30 and includes inlet ports 38, 40 which communicate with volumes 42, 44 located on either side of the plate 36. The inner plate 46 is shaped to pivot over and close a concave combustion chamber 48 formed in the stator 24. The combustion chamber 48 includes an interior, concave combustion surface 50 and a central depression 52 which includes a spark plug 54 of conventional design. Accordingly, when the blade 30 is pivoted to the position shown in FIG. 7, the inner plate 46 is pivoted away from the surface 50, and the outer plate 36 is pivoted toward the stator wall 26, thereby minimizing the volume 44.

Figure 3:
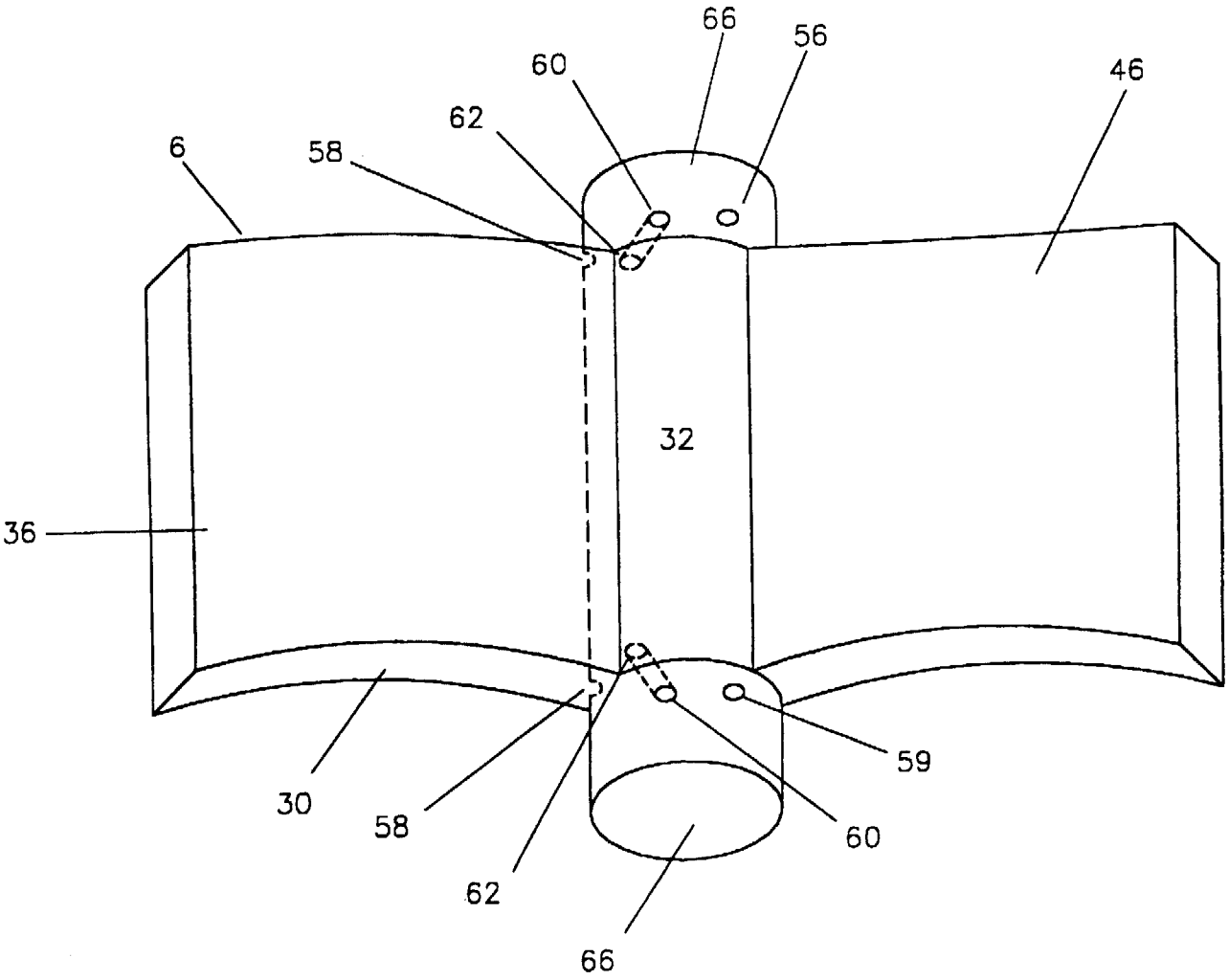
FIG. 3 is a perspective view of a V-shaped blade of the stator of FIG. 2.
Figure 4:
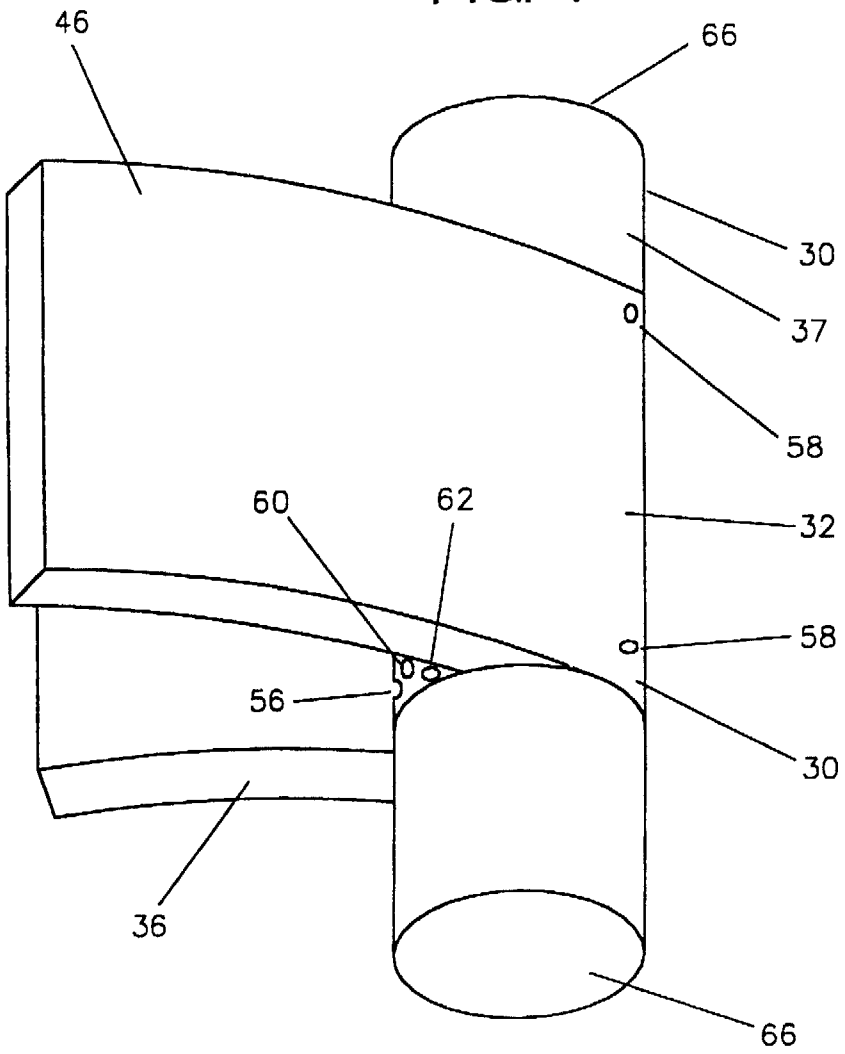
FIG. 4 is a perspective view of a V-shaped blade of the stator of FIG. 2 rotated from the position of FIG. 3.

As shown in FIGS. 3 and 4, the blades 30 include upper and lower fuel-air inlet ports 56, 58 and upper and lower purging air ports 60, 62. As shown in FIGS. 4 and 7, a fuel air mixture enters the compression chamber 34 through opening 38. As the V-shaped blade 30 pivots about pivot body 32, the fuel air mixture in the chamber 34 is compressed by the movement of the plate 36 toward the wall 42, and at the same time is forced through the opening 58 through a passageway 62 (see FIG. 14) and out opening 60 into the combustion chamber 48.

Figures 14, 14A, 14B:
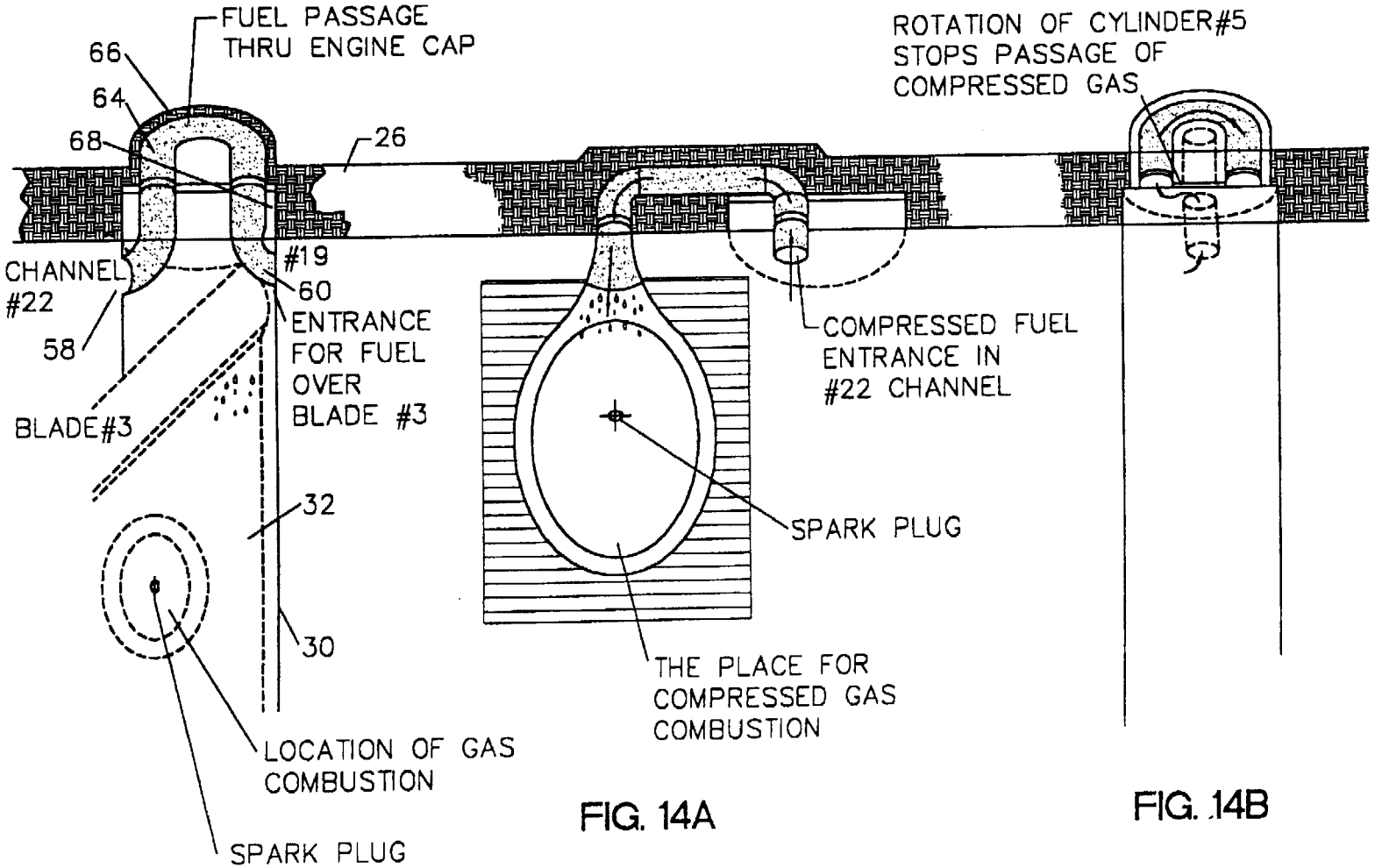
FIG. 14 is a detail perspective view of a cylindrical pivot body of a V-shaped blade of the embodiments of FIGS. 1–13.
FIG. 14A is a schematic detail showing the blade of FIGS. 3 and 4 rotated to an open position.
FIG. 14B is a schematic detail showing a component of the blade of FIGS. 3 and 4 in a closed position.

Similarly, when the V-plate 36 pivots about pivot body 32 to the position shown in FIG. 7, purging air, which enters through opening 40 into chamber 44, is forced through opening 62 through passageway 64 to opening 60. As shown in FIG. 14, passageway 64 is formed within an end cap 66. The pivot bodies 32 are, in turn, journaled within recesses 68 formed in the stator wall 26. As shown in FIG. 14, the passageway 64 and end cap 66 is common to both holes 58, 60 and their associated passageways, as well as holes 60, 62 (see FIG. 4) and their associated passageways.

Figure 8:
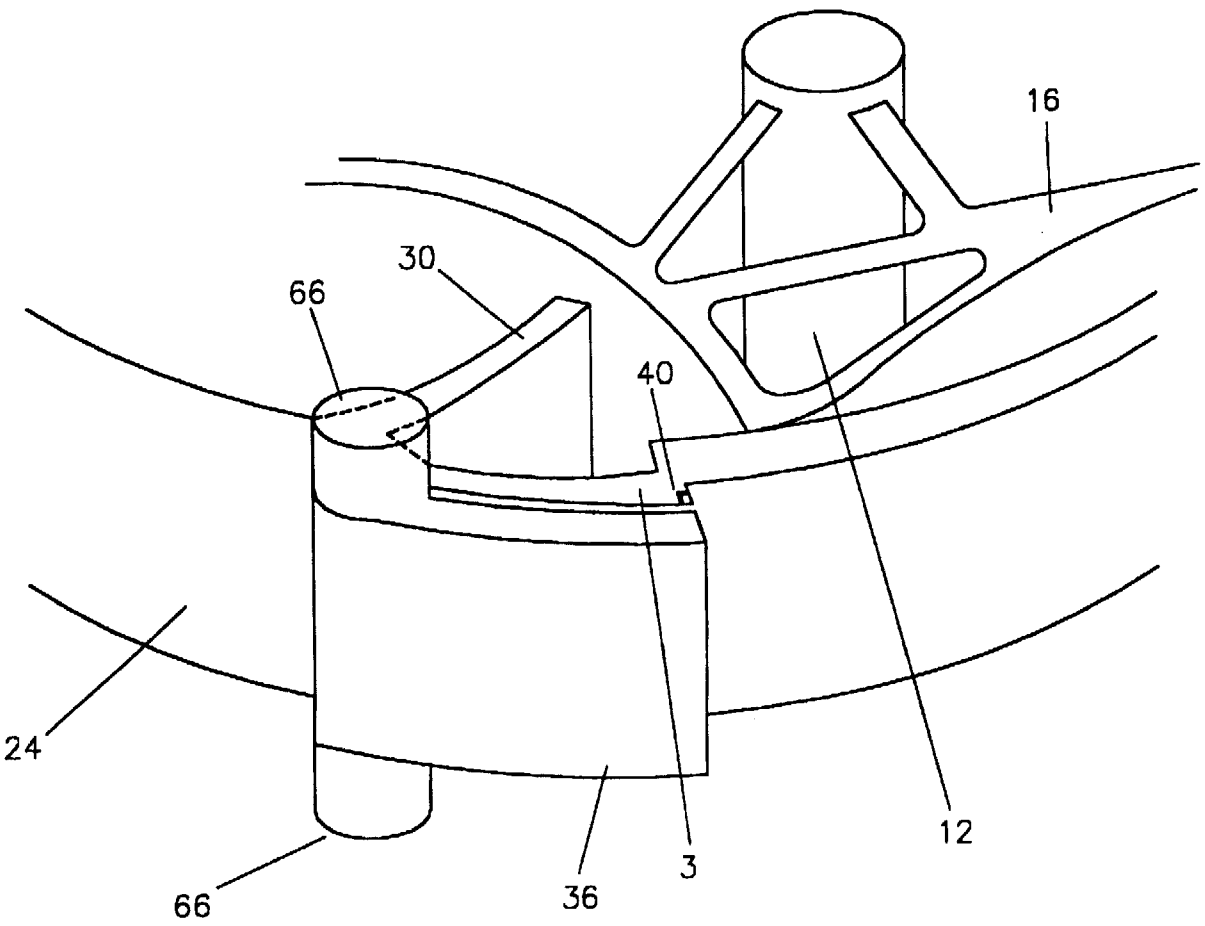
FIG. 8 is a detail perspective view showing the stator of FIG. 2, a V-shaped blade, and an associated portion of the rotor of FIG. 1.
Figure 9:
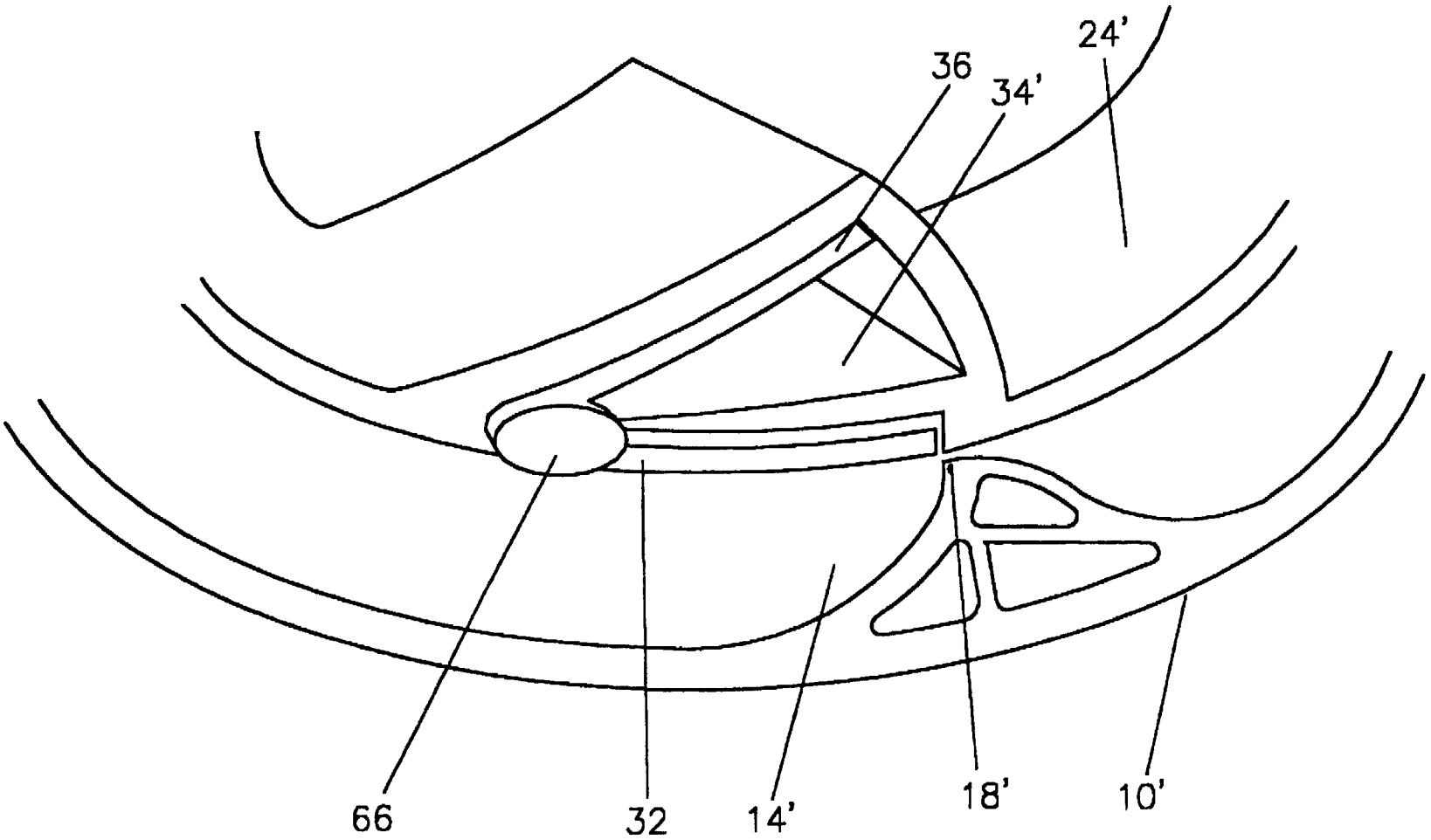
FIG. 9 is a detail perspective view showing portions of the stator and rotor of an alternate embodiment of the invention.
Figure 10:
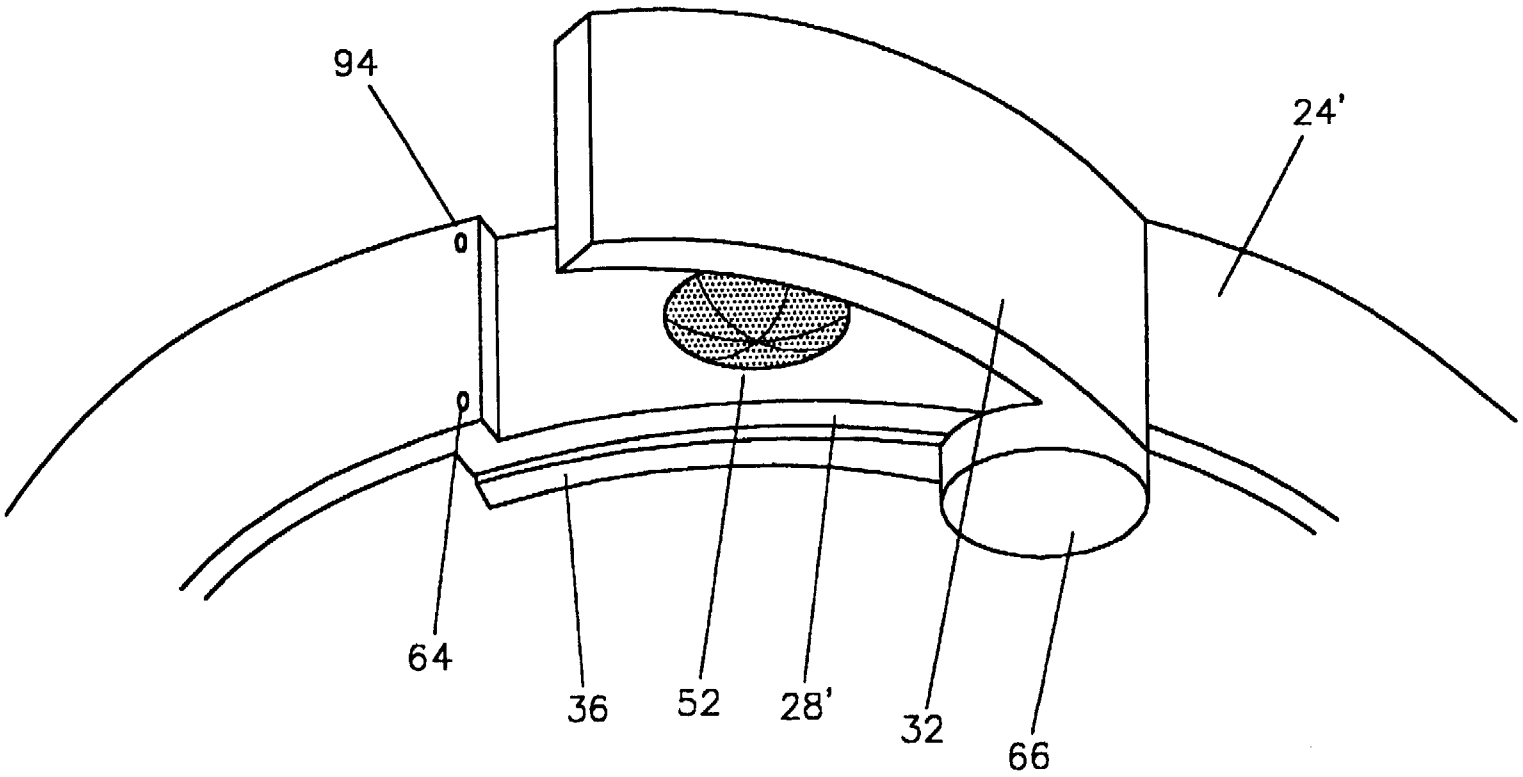
FIG. 10 is a detail showing the V-shaped of the alternate embodiment of the invention of FIG. 9.
Figure 12:
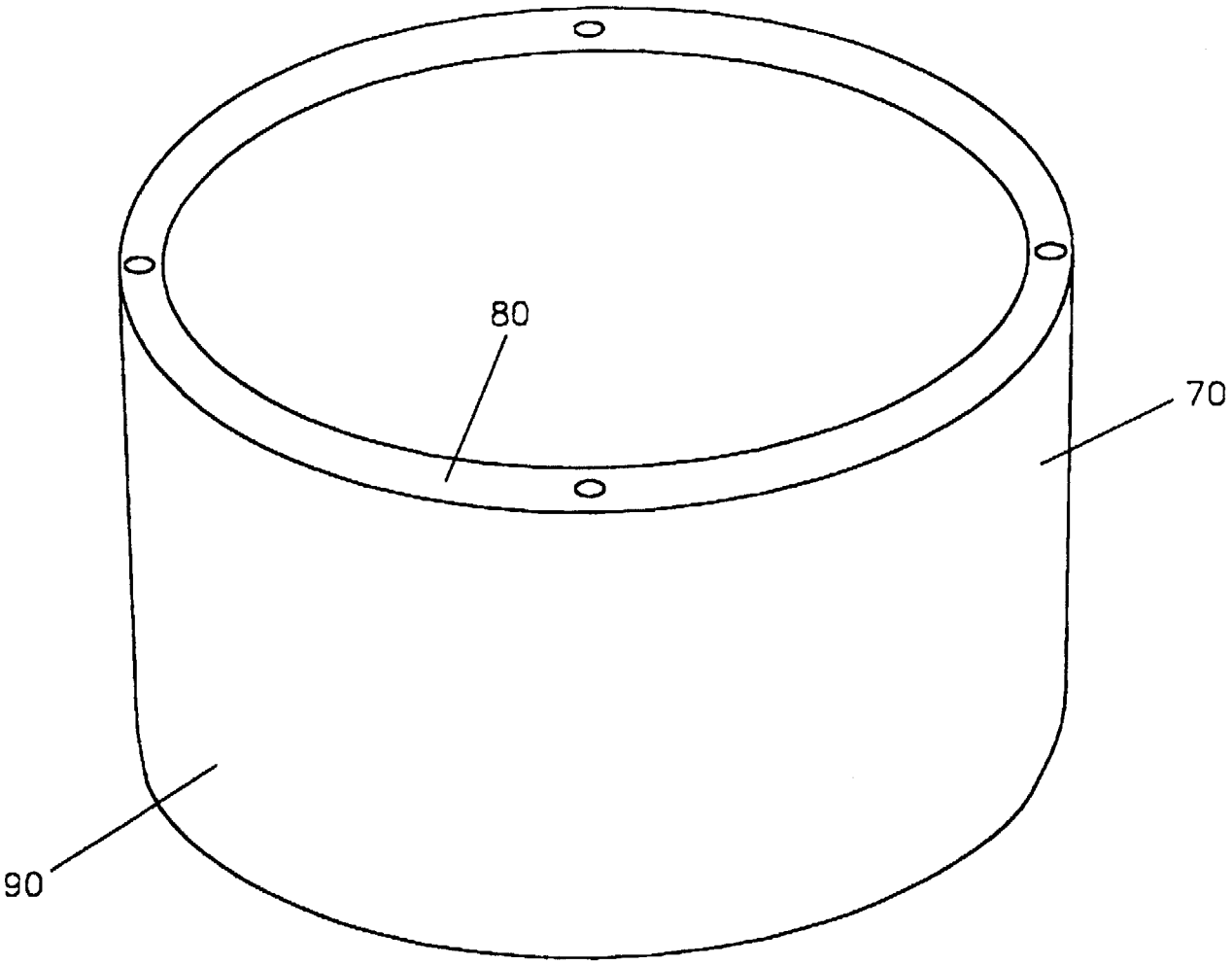
FIG. 12 is a perspective view of the outer cylindrical housing of the embodiment of FIGS. 1 and 2.

As shown partially in FIG. 8, the stator 24 and rotor 10 are concentric with each other about axis 12, and the combination is sized to fit within a cylindrical outer housing 70 (shown in FIG. 12).

Figure 5:
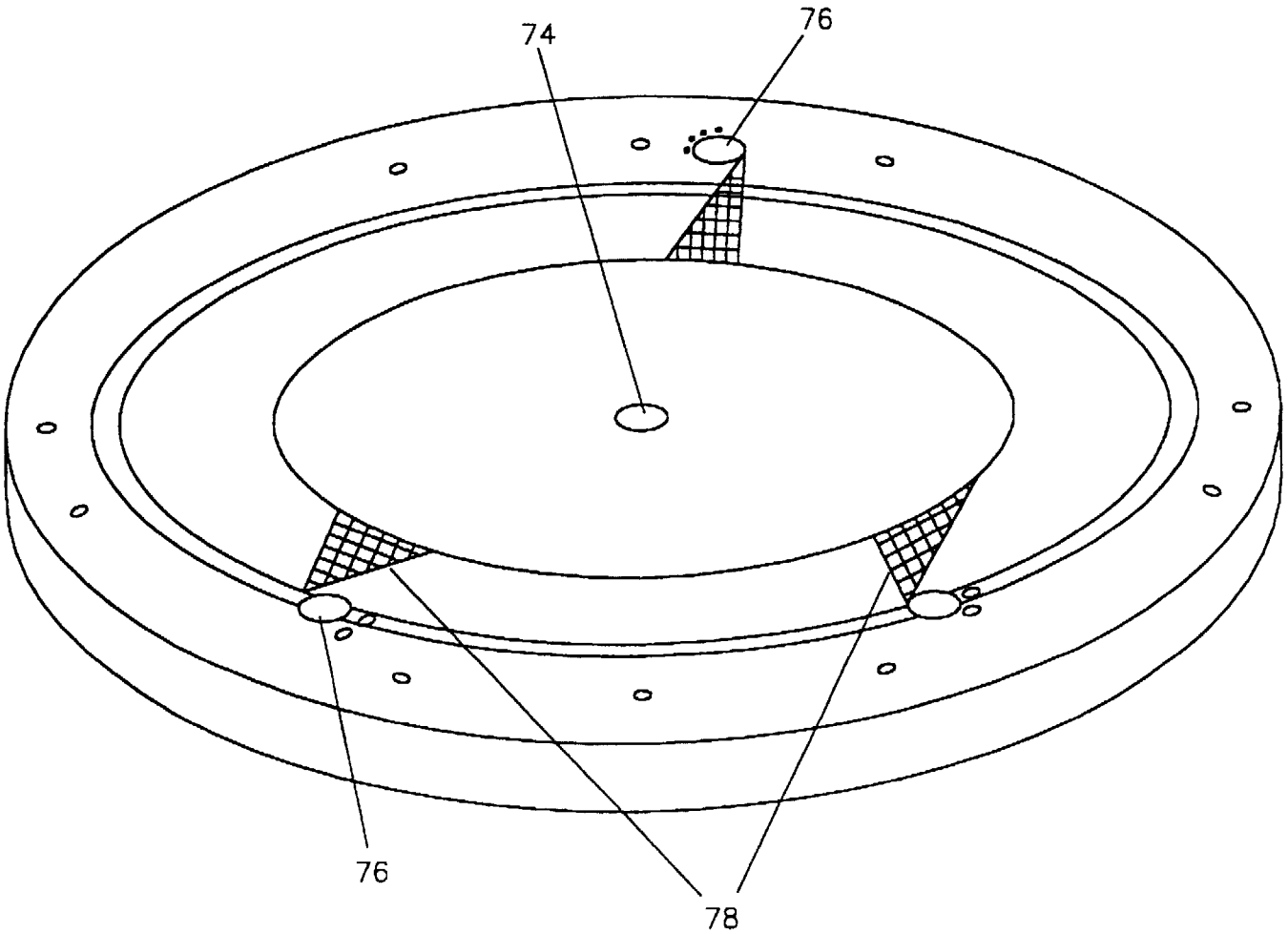
FIG. 5 is a perspective view of the upper and lower end plates of the preferred embodiment of the rotary engine of the present invention.

As shown in FIG. 5 the housing 70 is enclosed at upper and lower ends by top wall 72. Wall 72 each include a central opening through which protrudes an output portion 74 of central shaft 12 (see FIG. 1). Top and bottom walls 72 also include openings 76 which are shaped to receive end caps 66 (see FIG. 14). Exhaust gases from the combustion chamber 48 leave the engine through triangularly shaped openings 78.

An alternate embodiment of the invention is shown in FIGS. 9, 10, 11 and 13. With this embodiment, the rotary engine includes a rotor 10' which extends about the outer periphery of a central stator, generally designated 24'. The rotor 10' and stator 24' are concentric with each other about a common area 94, which is open and may serve as a payload carrying area, command center, or the like. The outer rotor 10' includes three lobes or noses 18' which are part of an inwardly-facing camming surface 14'.

The stator 24' includes an annular wall 26' which, in turn, includes offset walls 28'. A pair of opposing, V-shaped blades 30 each include a cylindrical pivot body 32 which is received within a correspondingly-shaped cylindrical recess 34' formed in the stator 24'. The blades 30 are identical to the blades 30 (see FIGS. 3 and 4) of the previously-described embodiment in both construction and function. Similarly, the lobes 18' of the rotor 10' are identical in contour and function to the lobes 18 of the rotor 10 of FIG. 1.

Figure 11:
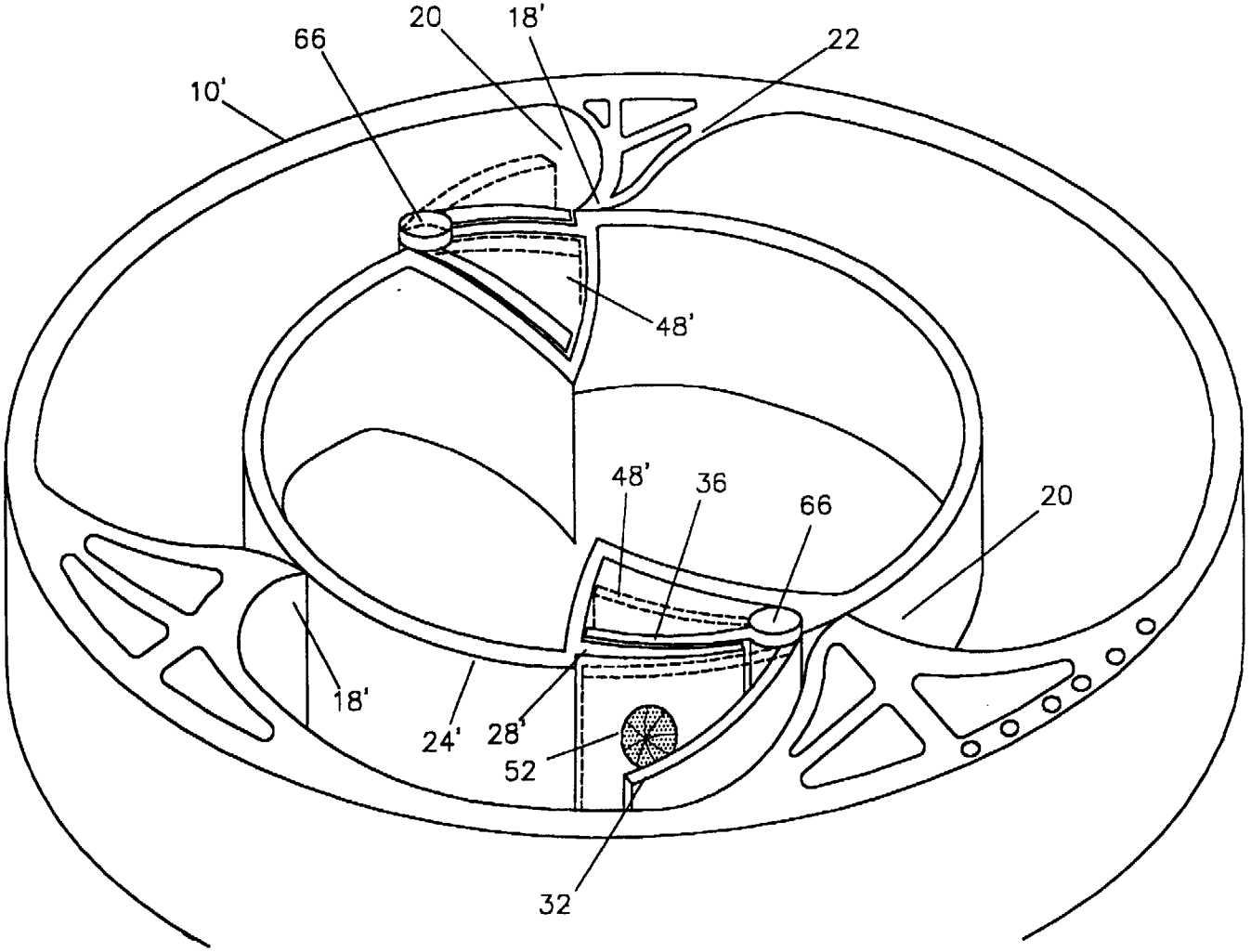
FIG. 11 is a perspective view of the rotor and stator arrangement of the alternate embodiment of FIG. 9.
Figures 13, 13A:
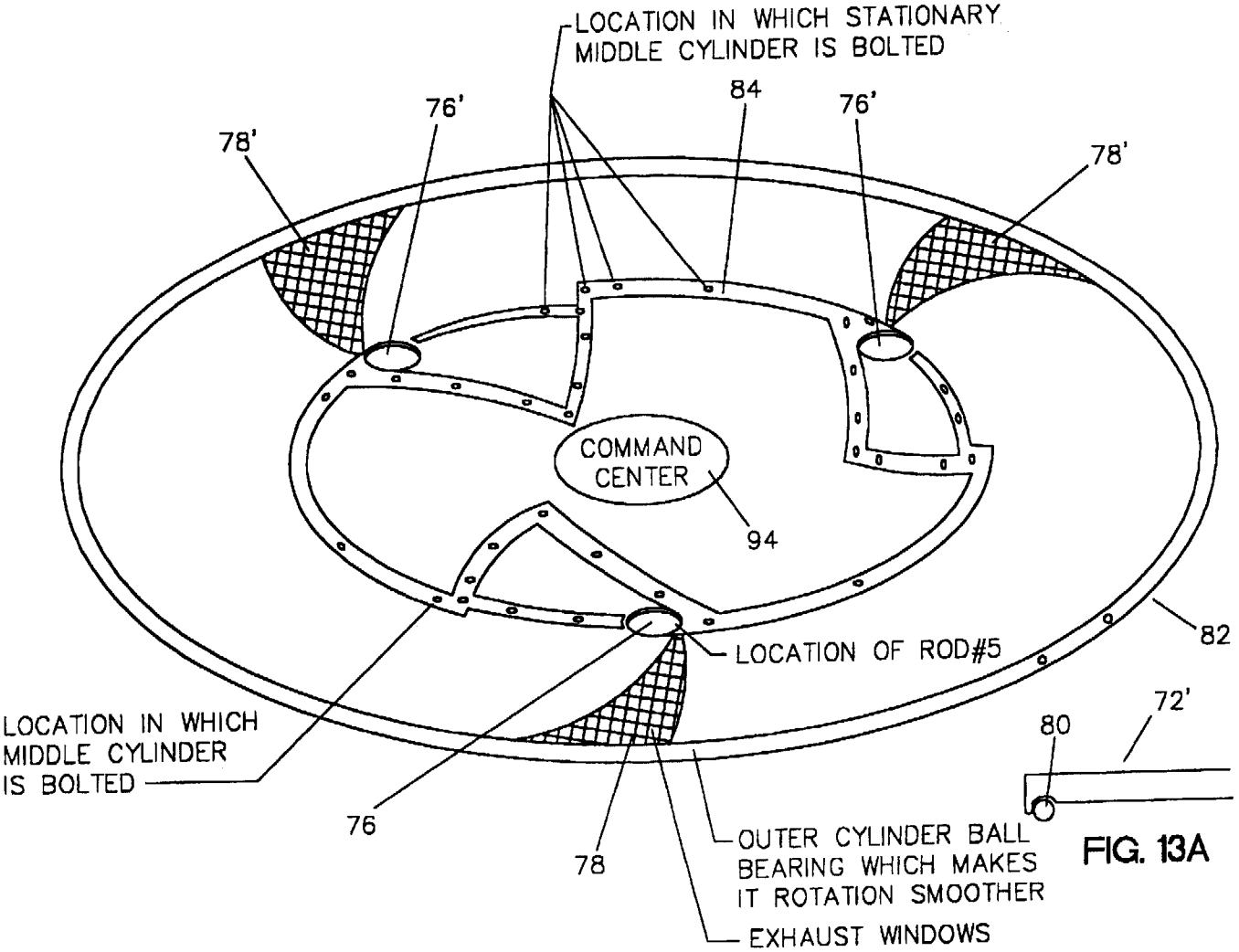
FIG. 13 is a perspective view of the upper and lower end plates of the embodiment of FIGS. 9.
FIG. 13A is a detail of the end plates of FIG. 13.

As shown in FIG. 13, the top and bottom walls 72' of the embodiment of FIG. 11 include openings 76' which are shaped to receive end caps 66 (See FIG. 14). Exhaust gases from the combustion chamber 48' (see FIG. 10) leave the engine through triangularly shaped openings 78'. The undersides of the top and bottom walls 72' each include a peripheral groove 80 (see FIG. 13A) which receives a plurality of ball bearings 82. The ball bearings 82 contact upper and lower annular peripheral end edges 84 of the rotor 14' (see FIGS. 9, 10 and 11). The upper and lower walls 72' also include support structure 84 which is shaped and sized to be bolted to the stator 24'.

The command center 85 of the embodiment of FIG. 11 is surrounded by a wall (not shown) similar to the cylindrical wall 70 of FIG. 12.

The operation of the rotary engine of FIGS. 1–15 is as follows. A fuel air mixture is introduced through opening 38 (having a check valve) into the compression chamber 34. As the rotor 10 rotates relative to the stator 24, the edge of the plate 46 contacts the camming surface 14 of the rotor 10 and, when it encounters the leading edge 22 of the rotor is forced to pivot inwardly toward the stator wall 26. This, in turn, forces the blade 36 outwardly away from the wall 26 which reduces the volume of the compression chamber 34. This reduction in volume serves to force the fuel air mixture through the passageways 58 and out opening 62 into the combustion chamber 48. The spark plug 54 ignites the fuel air mixture in the combustion chamber 48 when the nose 18 contacts the switches 94 formed on the inside of the wall 26 of the stator 24. The resulting explosion of the fuel air mixture in the combustion chamber 48 forces the V-blade 30 to pivot. This pivoting action urges the plate 46 against the rotor 10, which, when contacting the concave trailing edge 20, forces the rotor 10 to rotate counterclockwise, as shown in FIG. 1.

The exhaust gases of this combustion exit through opening 78 in the top plate 72.

The expansion of the gases in combustion chamber 48 against plate 46 causes the corresponding plate 36 to pivot inwardly toward the wall 26. This compresses air in chamber 44 (which has entered through opening 40) and forces the compressed air through opening 62 through passageway 64 and exits opening 60 into the combustion chamber, to purge the combustion chamber of exhaust gases through exhaust opening 78. The rotary engine is then able to begin the combustion cycle anew.

As is apparent from the foregoing description, in order to maximize the efficiency (in terms of getting the most power for an engine of a given size), it is preferable to maximize the number of combustion events which occur during one 360° rotation of the rotor. The number of combustion events per complete rotor rotation can be determined by multiplying the number of noses 18 by the number of combustion chambers 48:

(No. of noses) × (No. of combustion chambers) =

Number of combustion events per rotation of rotor

For example, if the number of noses of the stator is 10 and the number of combustion chambers is 9, the number of combustion events per rotation of the rotor would be 90. Consequently, the motor of the present invention can be modified to generate a great deal of power simply by increasing the number of rotor noses and combustion chambers. It is preferable to provide more stator noses than combustion chambers in order to avoid pulsing and to minimize the generation of heat. Furthermore, since combustion chambers are more complex and heavy than stator noses, it is preferable to increase the number of stator noses over increasing the number of combustion chambers.

It is apparent from the foregoing that the two embodiments of the invention can be incorporated in a number of vehicles. For example, the motor of the first embodiment can be employed in a ship to drive the ship's propeller, or in mining machinery to drive the head of a tunnelling machine or well-drilling machine or an aircraft, in which case the motor could drive the propeller or engine turbine. With respect to the second embodiment, propeller (or turbine) blades can be attached directly to the outer cylindrical wall of the rotor, and the portion central to the inner stator can be used to house a payload or command center.

The preferred embodiment of the invention is intended to be modular in design, so that units of the invention can be stacked or "ganged" together in a column. With the first embodiment, such an arrangement would have a common output shaft, and with the second embodiment, the stack would have a common rotating outer wall.

Figure 15:
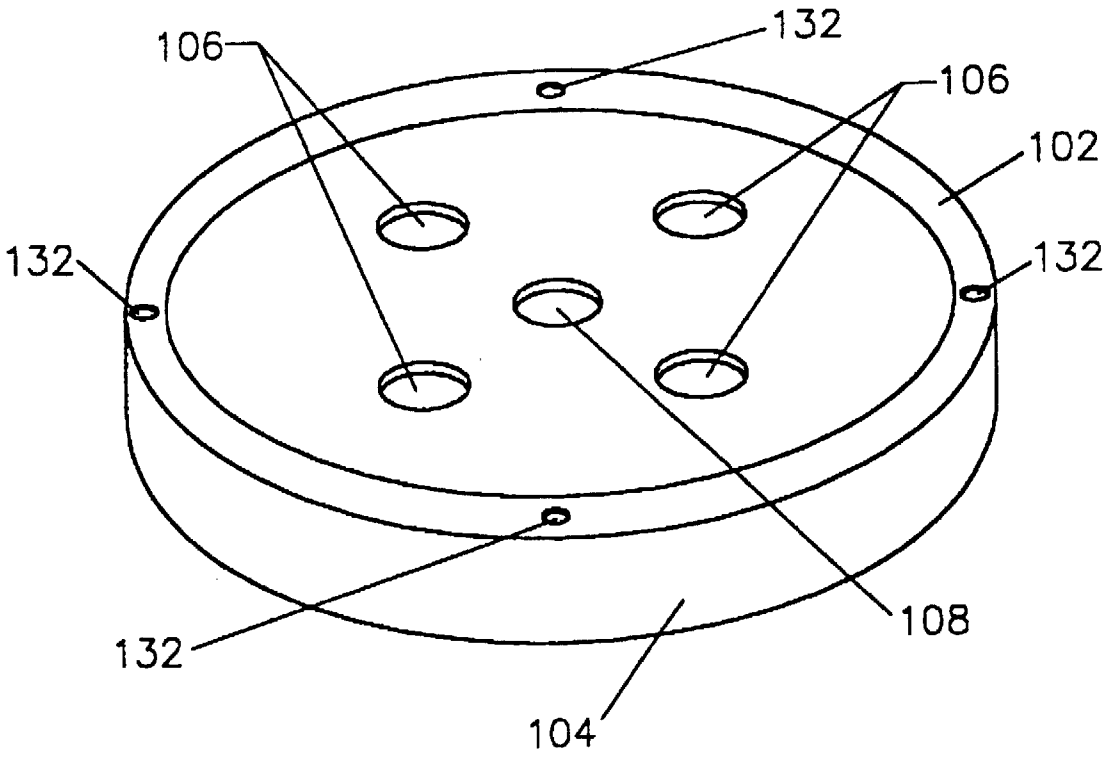
FIG. 15 is a perspective view of a cylinder block of an alternate embodiment of the invention.
Figure 16:
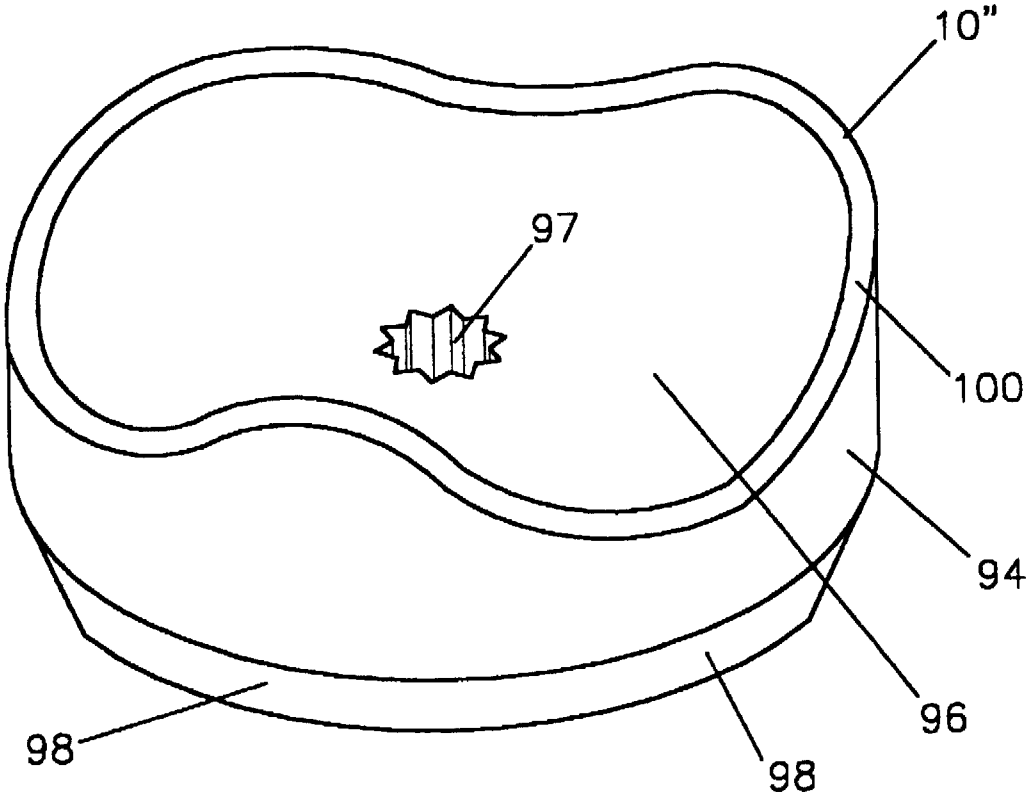
FIG. 16 is a perspective view of a bowl of the embodiment of FIG. 15.

Another embodiment of the invention is shown in FIGS. 15 and 16. In this embodiment, the rotary engine includes a rotor or bowl 10" which comprises a cylindrical wall 94, a bottom wall 96 having a central, toothed opening 97 and a beveled outer periphery 98. The upper edge 100 of the cylindrical wall 94 has an undulating contour and is hardened to form a camming surface.

As shown in FIG. 15, the embodiment 10" includes a block, generally designated 102, having a thickened outer periphery 104 and a plurality of cylinders 106 formed there through. Each of the cylinders 106 has a central axis which is parallel to the central axis of the bowl 10". The block has a central opening 108 which is collinear with the toothed opening 96 of the bowl.

Figure 20:
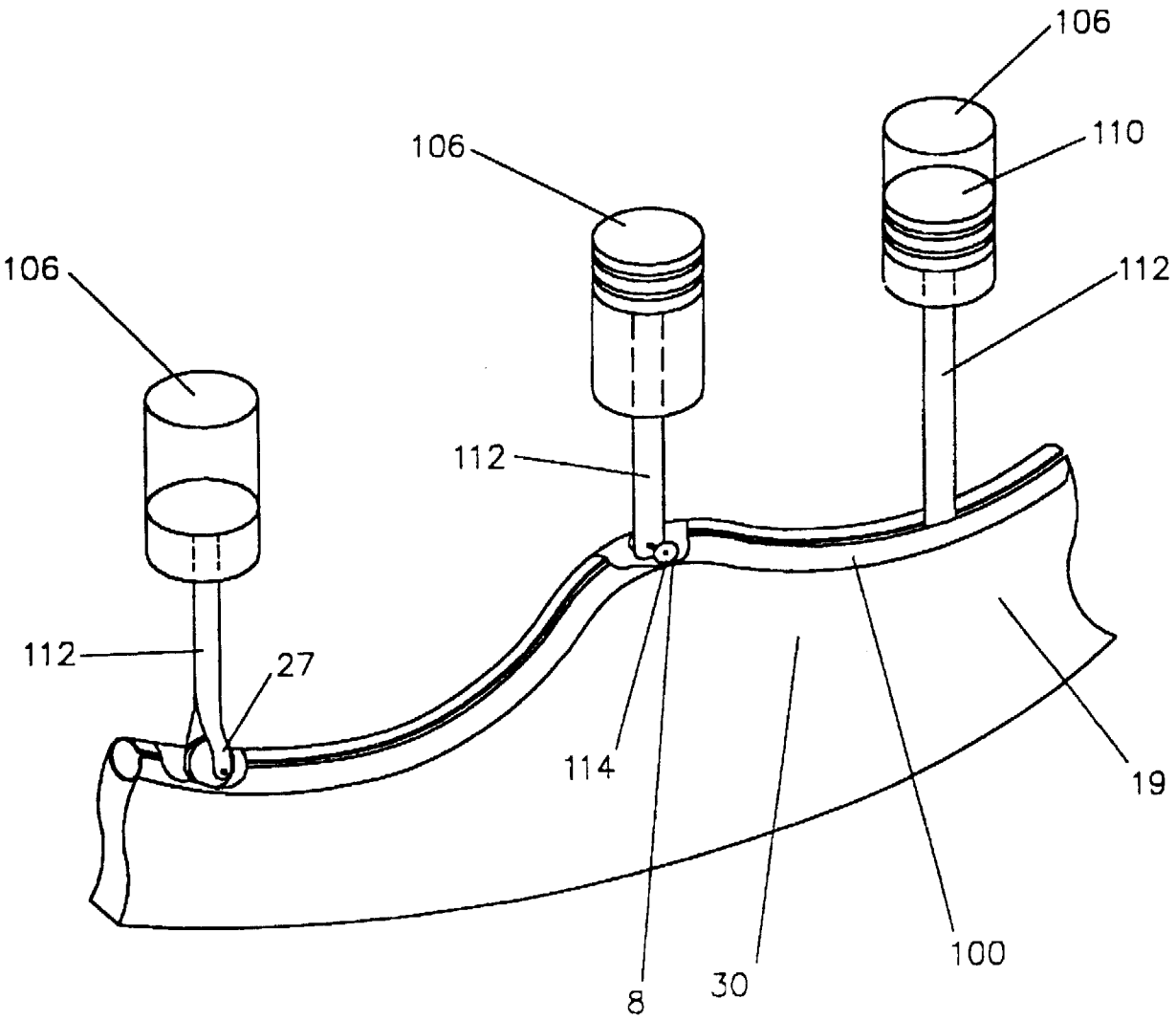
FIG. 20 is a detail showing the cylinders and pistons in cam track of the embodiment of FIG. 15.

As shown in FIG. 20, each of the cylinders 106 formed in the block 102 receives a piston 110 having a rod 112 which terminates at its lower end in a cam wheel 114. The cam wheels 114 are shaped and positioned to contact the cam surface 100 of the bowl 10".

Figure 19:
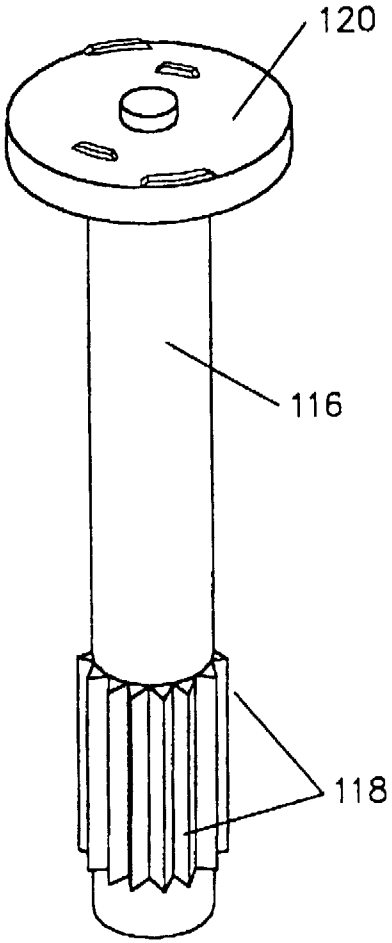
FIG. 19 is a perspective view of the central shaft of the embodiment of FIG. 15.

As shown in FIG. 19, a central shaft 116 is shaped to be inserted between the bowl 10" and block 102, and includes a toothed section 118 which is shaped to engage the tooth hole 96, and an upper flange 120 which is shaped to protrude above the upper surface of the block 102 through opening 108.

Figure 18:
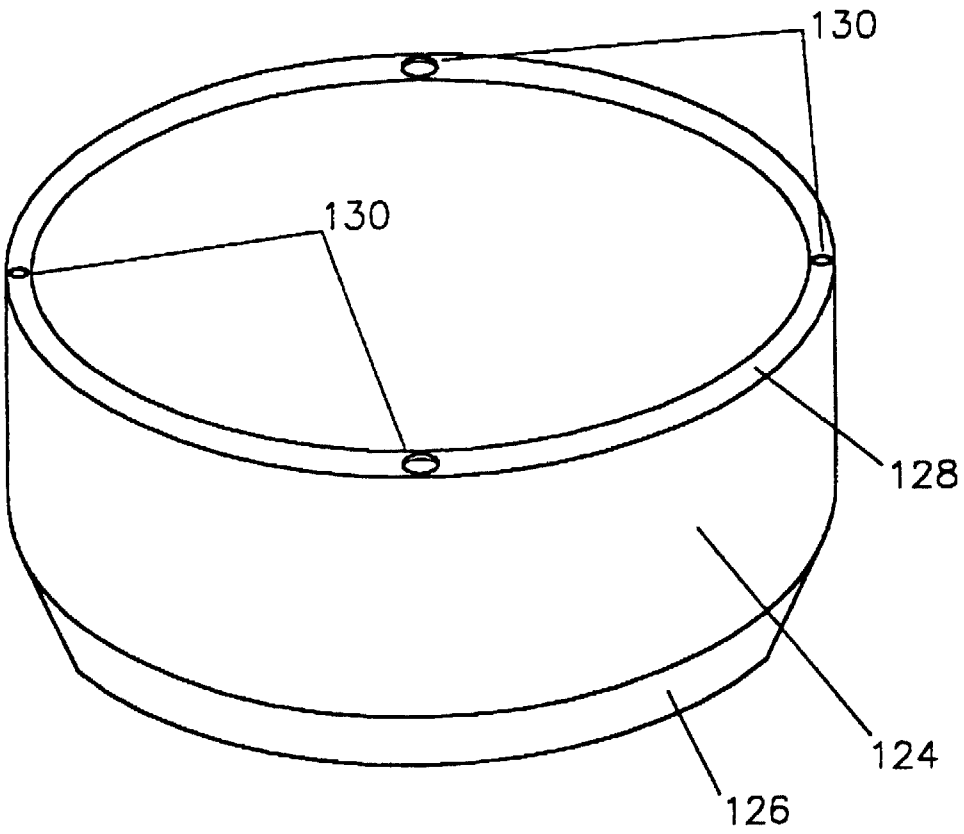
FIG. 18 is a perspective view of a casing shaped to receive the bowl of FIG. 16.

As shown in FIG. 18, the engine includes an outer housing, generally designated 122, which is shaped to receive the bowl 10" within its interior, and includes an outer cylindrical wall 124 and a beveled bottom surface 126. The upper surface 128 of the oil pan 122 includes openings 130 to receive mounting bolts (not shown) which thread through corresponding openings 132 on the block 102 (see FIG. 15).

Figure 17:
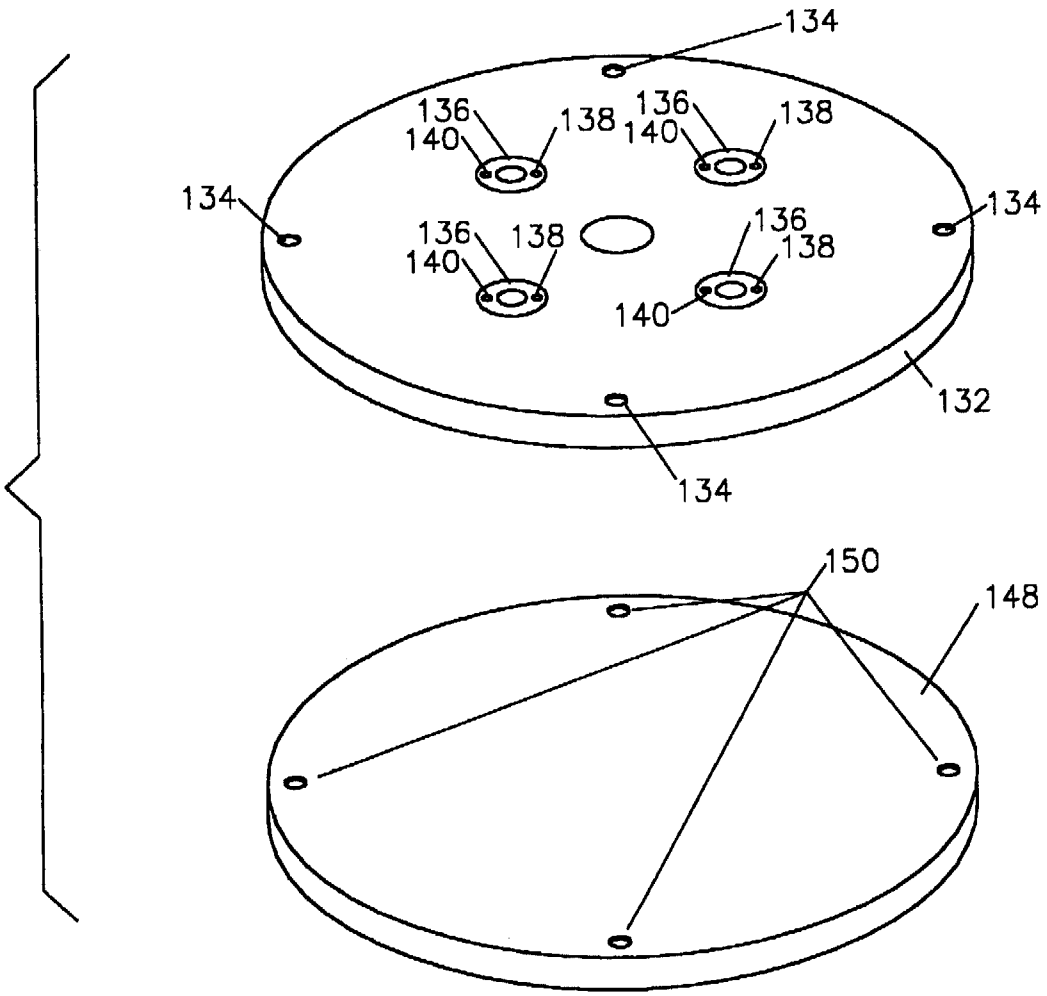
FIG. 17 is an exploded, perspective view of the top plate and valve head of the embodiment of FIG. 15.

As shown in FIG. 17, the engine includes a disk-shaped valve head 132 which is mounted on top of block 102 and is bolted to the block through holes 134. Valve block 132 includes the heads 136 of the cylinders 106 of the embodiment of FIG. 15, and includes inlet valves 138, and exhaust valves 140.

Figure 21:
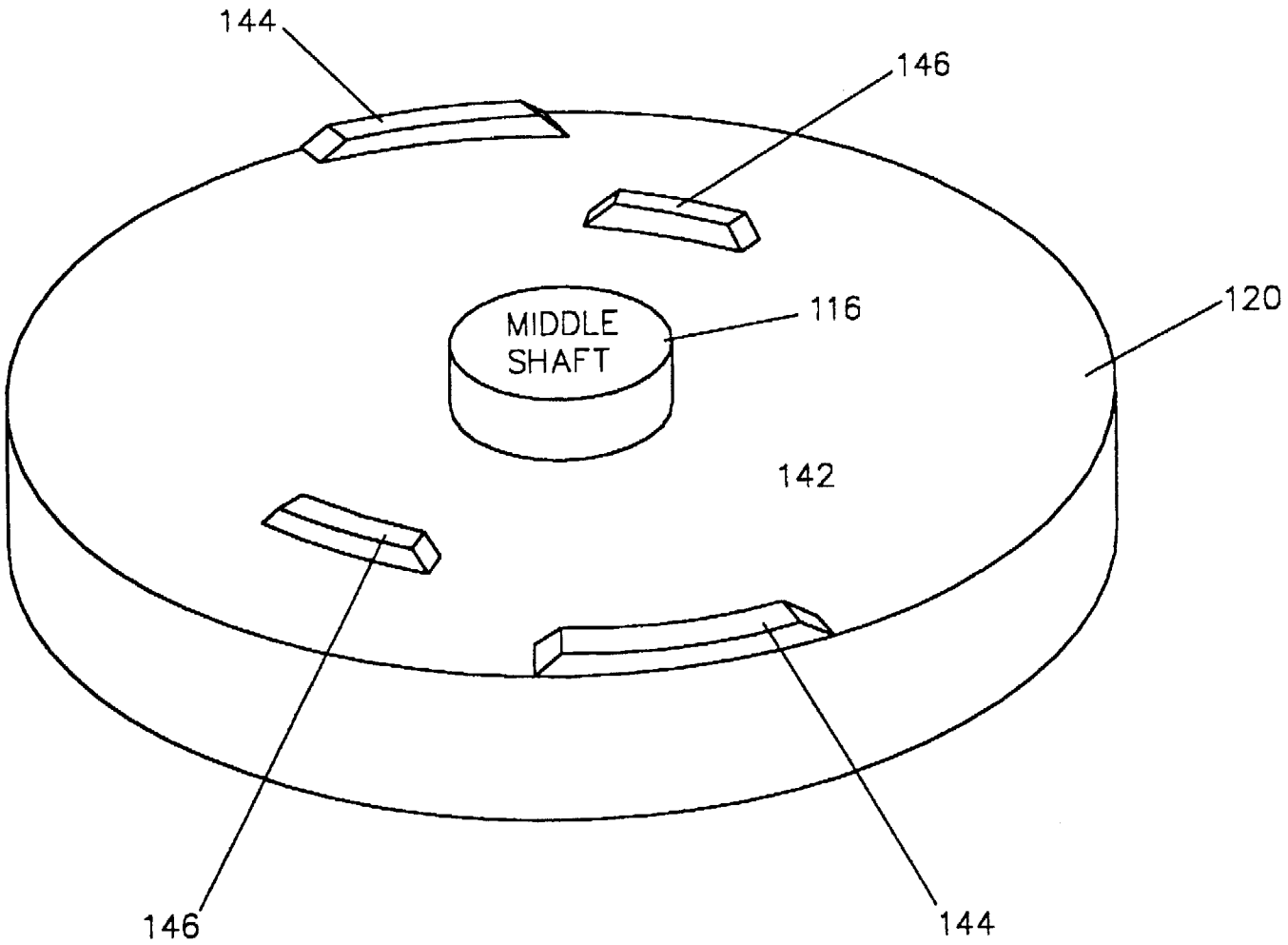
FIG. 21 is a perspective view of the underside of the top plate of FIG. 17, showing the camming surfaces.
Figure 22:
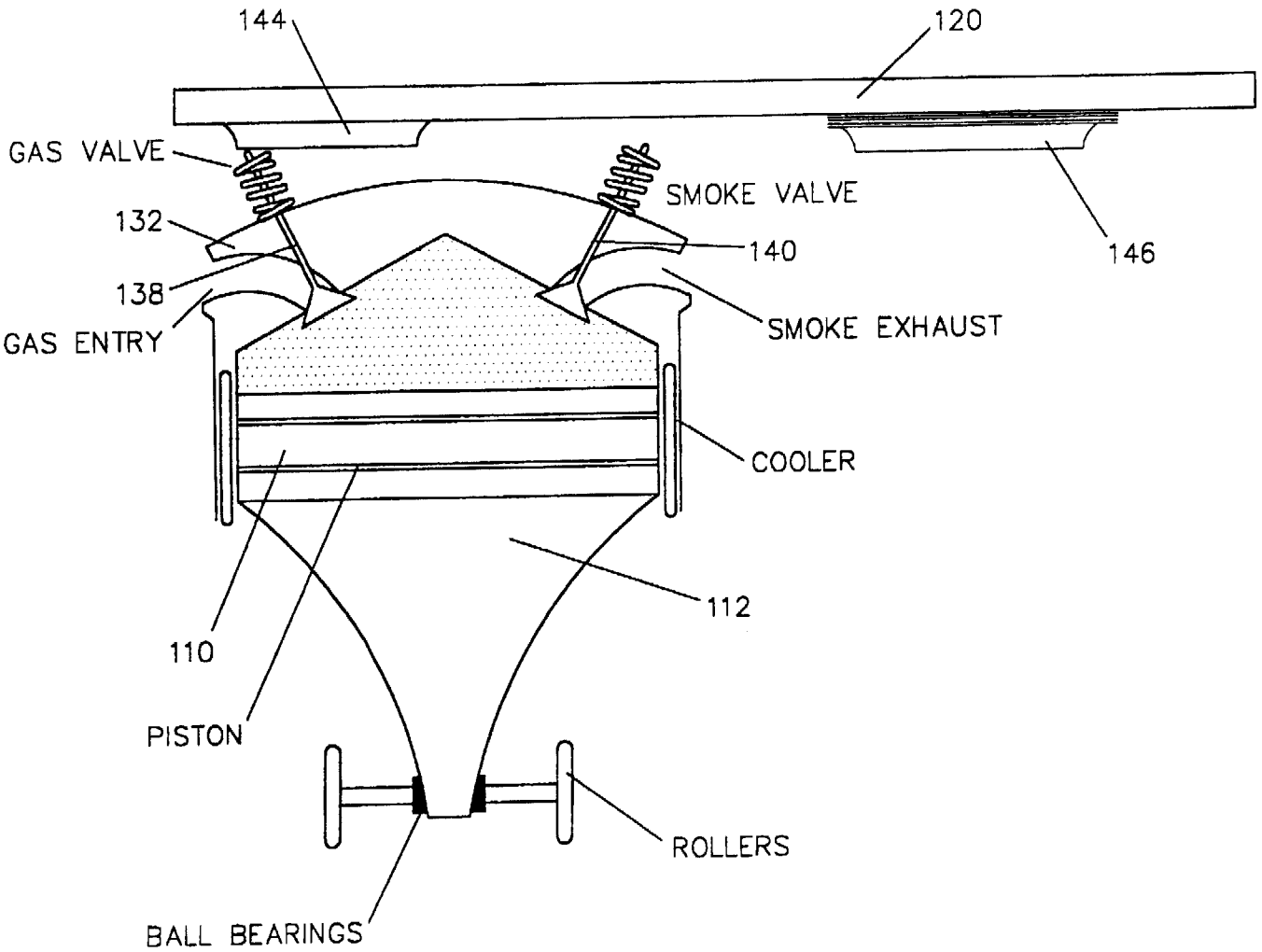
FIG. 22 is a detail showing the camming surfaces engaging the intake and exhaust valves of a cylinder of the block of FIG. 15.
Figure 23:
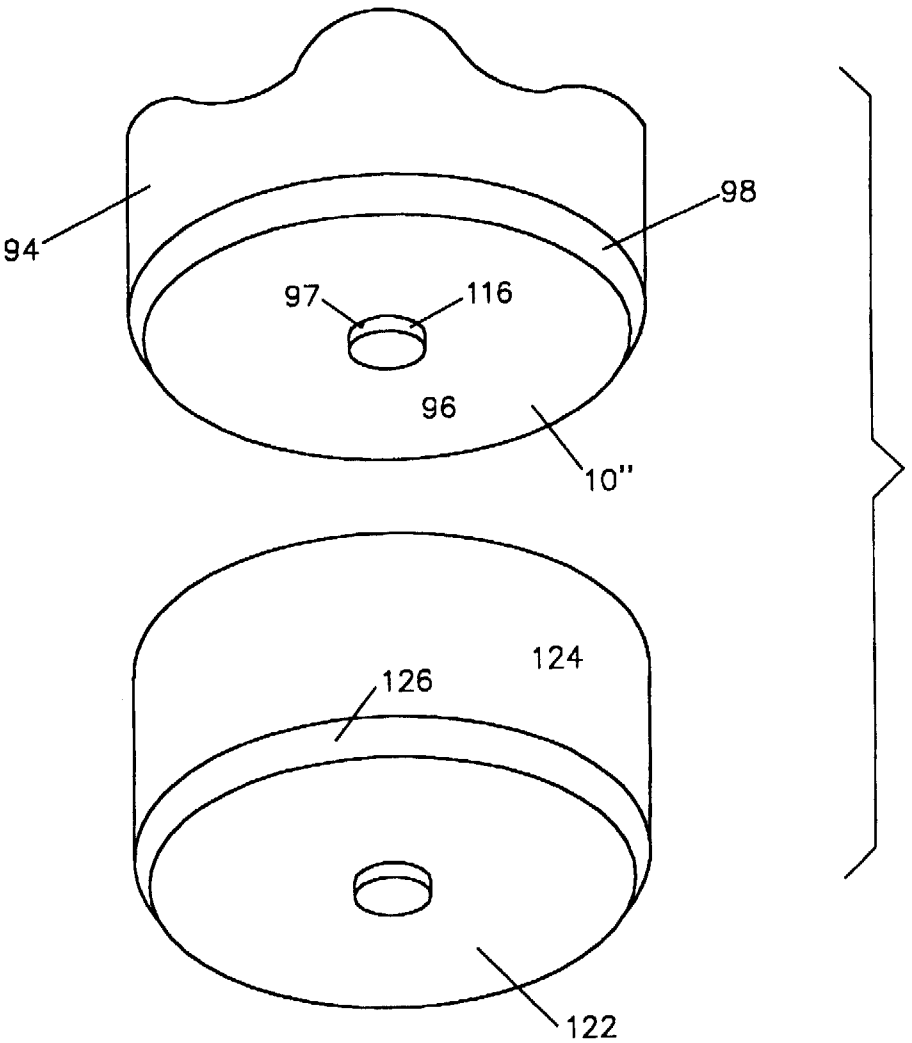
FIG. 23 is an exploded view showing the undersides of the bowl and casing.

As shown in FIG. 21, the underside surface 142 of the flange 120 of the central shaft 116 includes a plurality of cams 144, 146. Cams 144 are located radially outwardly of cams 146 and both cams are arranged in a concentric pattern. The flange is shaped to be positioned above the valves 138, 140, as shown in FIG. 22, so that the cams 144 sequentially contact the exhaust valves 140 and the inner cams 146 sequentially contact the inlet valves 138 as the shaft 116 is rotated relative to the valve head 132. The contact between the cams 144, 146 and valves and exhaust and inlet valves 140, 138, respectively, causes the valves to be opened. The valves are spring-loaded and, therefore, closed when not contacted by one of the cams 144, 146.

As shown in FIG. 17, a top plate 148 is shaped to be placed over the valve head 132 and flange 120, and is secured by through bolts (not shown) which extend through openings 150. Holes 150 are positioned to be in alignment with holes 134 of the valve head, holes 132 of the block and holes 130 of the oil pan 122.

Figure 24:
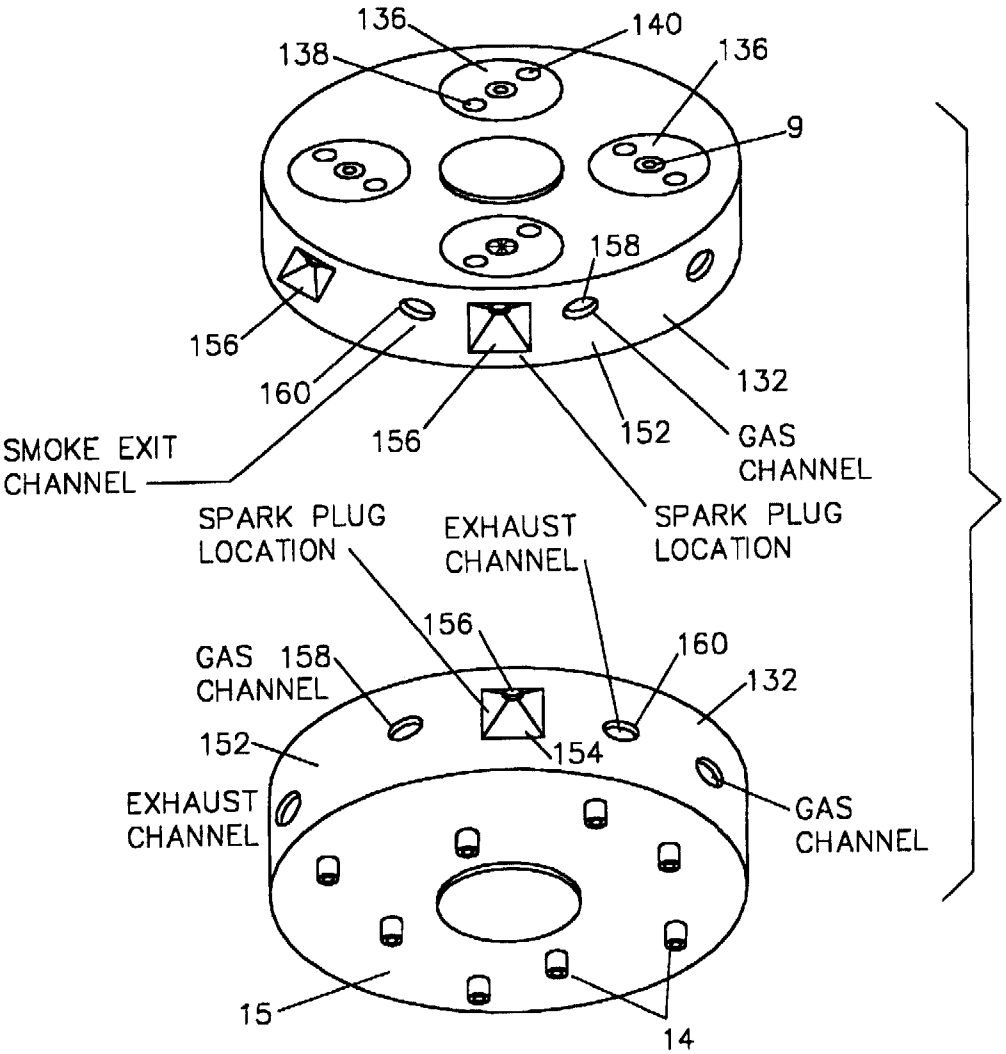
FIG. 24 is an exploded view showing the top and bottom views of the block of FIG. 15.
Figure 25:
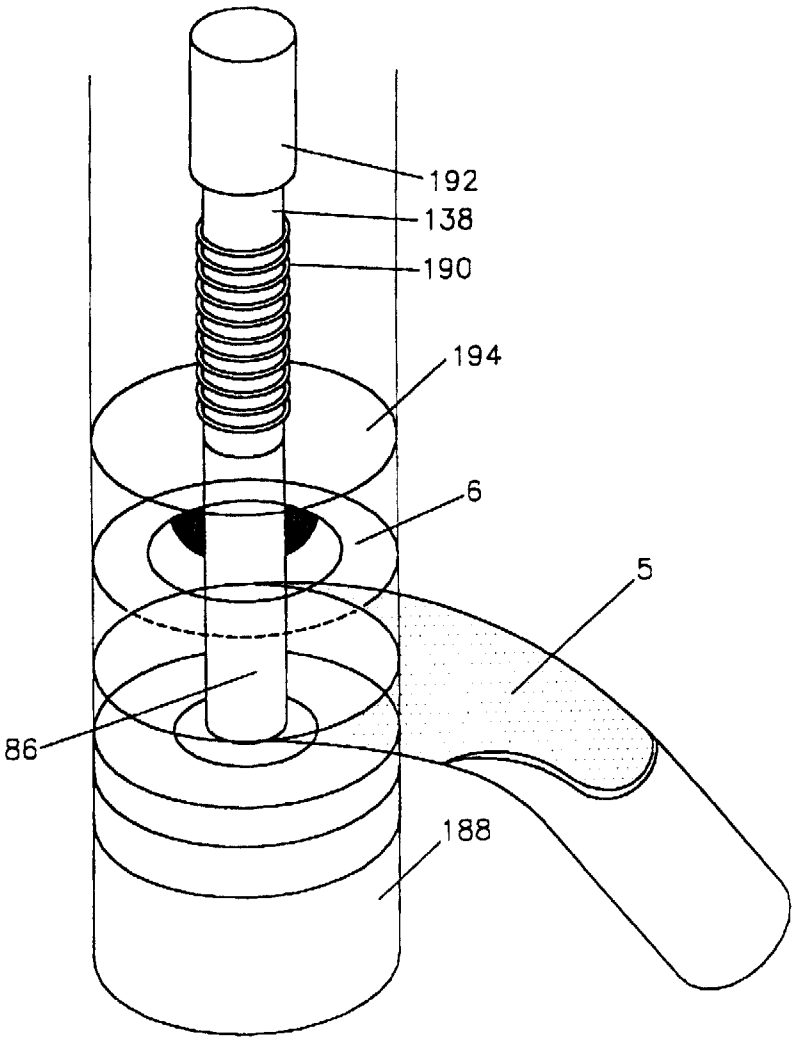
FIG. 25 is a detail showing a typical intake or exhaust valve of the embodiment of FIG. 15.

As shown in FIG. 24, two views of the valve head 132 are shown: the upper portion of FIG. 24 shows the bottom view of the valve head 132, and the bottom portion shows the upper view of the valve block. As shown in these two views of 26, the side wall 152 of the valve head includes spark plug access openings 154 for spark plugs 156 communicating with the cylinder heads 136, fuel-air mixture inlet channels 158, and exhaust channels 160. There is a spark plug 156, spark plug access opening 154, carbureted air inlet 158 and exhaust port 160 for each of the cylinders 106 (FIG. 20) of the engine 10".

Figure 26A:
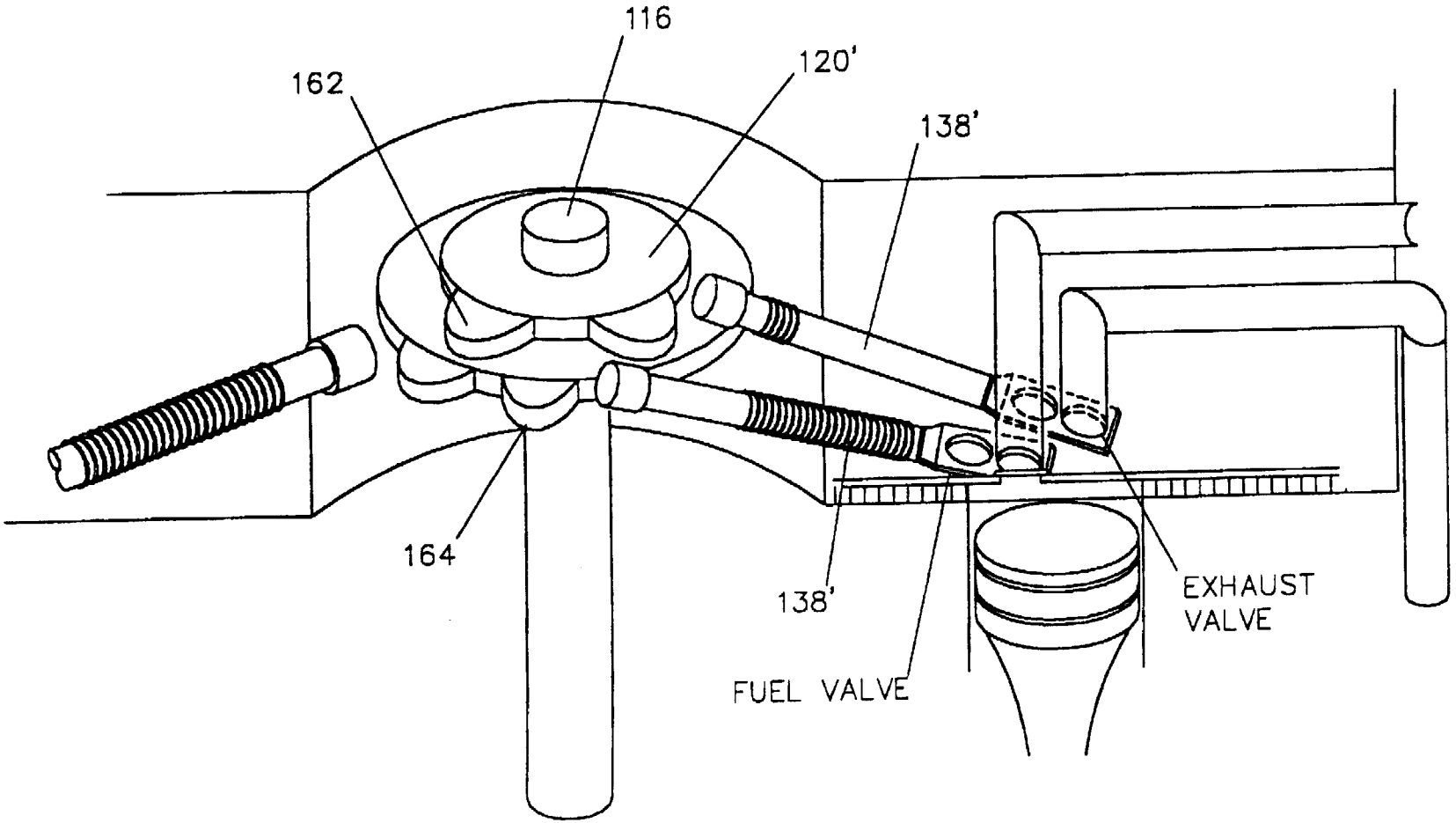
FIGS. 26 and 26A are perspective views of a stacked, radially extending cam assembly of an alternate embodiment of the invention.
Figure 26:
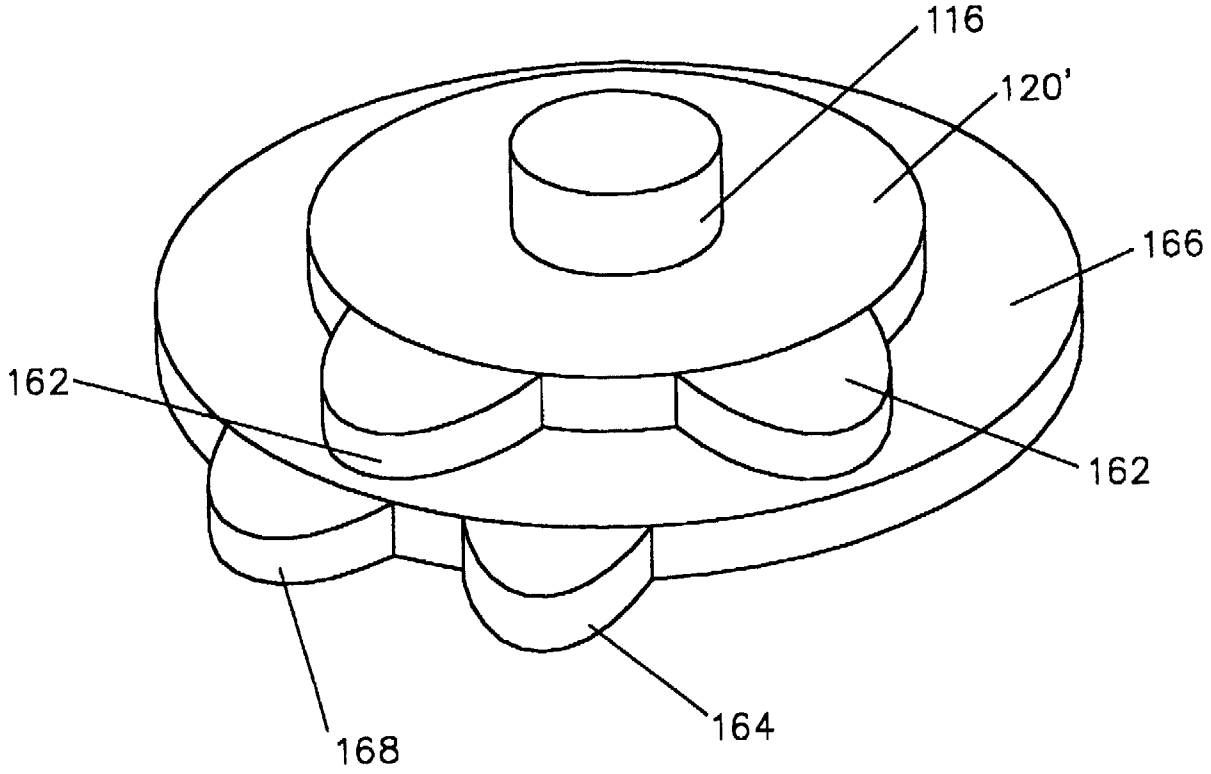

An alternate embodiment of the shaft 116 is shown in FIGS. 26 and 26A. The top flange 120' of the shaft 116 is modified to form a set of stacked, spaced cams, which include concentrically innercams 162 and concentrically outercams 164. Cams 162 project radially outwardly from a disk 166, while cams 164 project from disk 168. The cams 162 are shaped and positioned to contact the inlet valves 138' of the engine, while the cams 164 are positioned to contact and actuate the exhaust valves 138' (see FIG. 27).

Figure 27:
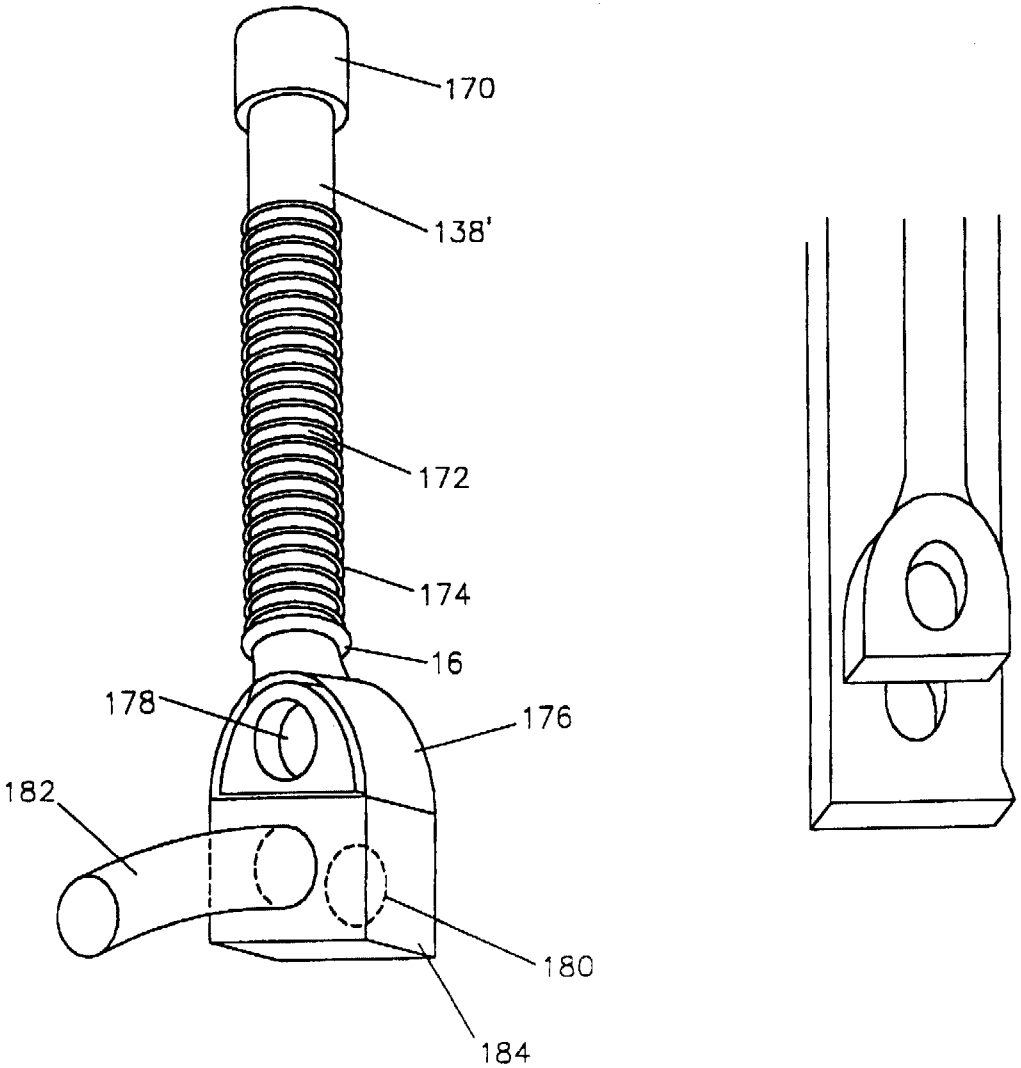
FIG. 27 is a perspective view of a radially extending valve.
Figure 29:
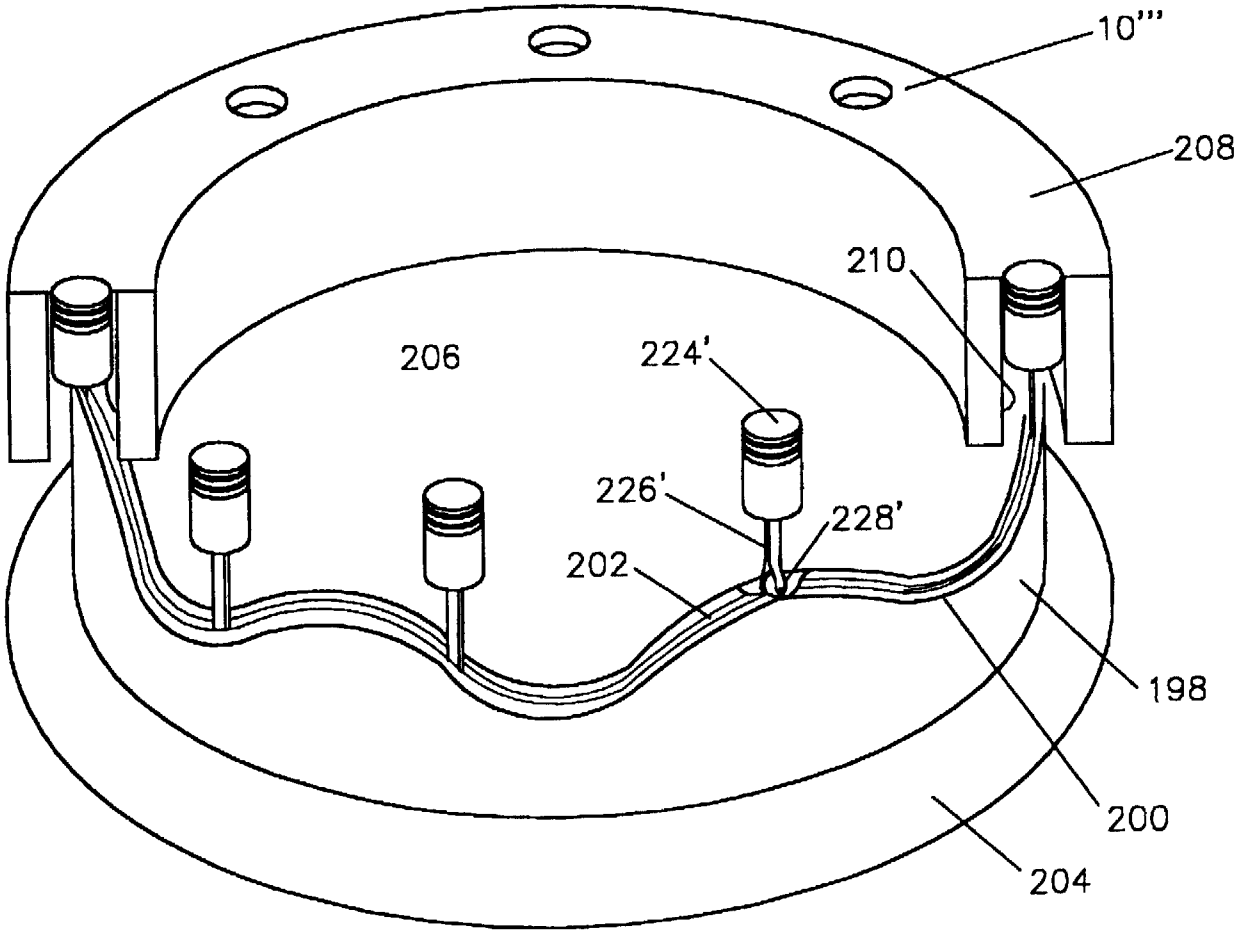
FIG. 29 is a perspective view, partially broken away and in section of a fourth alternate embodiment of the invention.

A typical valve 138', which may be either an inlet valve or an exhaust valve, is shown in FIG. 27. That valve 138' includes a radially inner tip 170, a valve rod 172, return spring 174 and head 176. The head 176 includes a central orifice 178 which is shaped to communicate with a port 180 (which may be either an exhaust port or an inlet port, depending on the application) and provide a continuous channel with a header 182 (which may be either inlet or exhaust). The head 176 slides within a chamber 184. The spring 174 is biased against the cap 170 and housing 184 to maintain the valve in a closed position as shown in FIG. 29.

Figure 28:
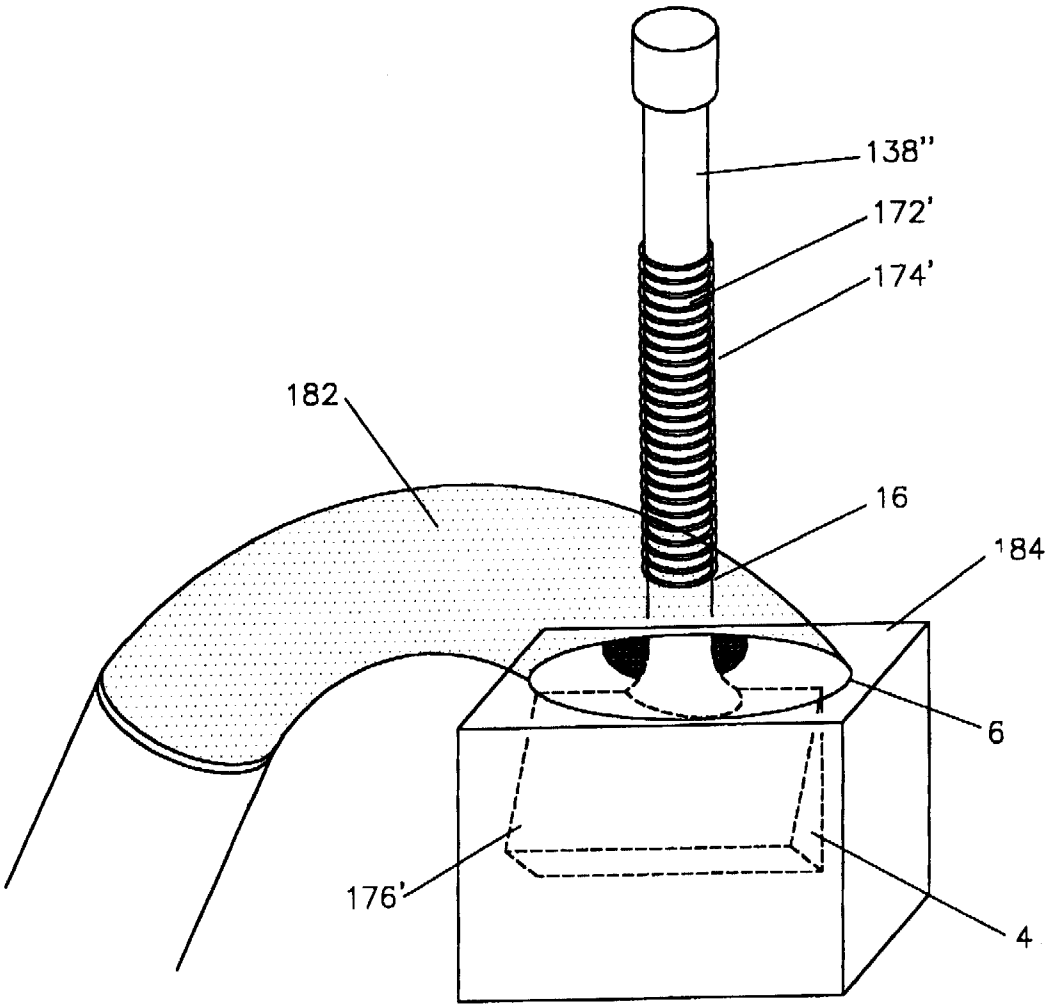
FIG. 28 is an alternate embodiment of the radially extending valve of FIG. 27.

An alternate embodiment of the valve 138" is shown in FIG. 28. That valve includes a cap 170', spring 174', shaft 172' and block 176', which is positioned within a housing 184'. The block 176' is wedge-shaped and is slidable between an open position, shown in FIG. 30, and a closed position, in which the block 176' covers the opening 180, which may be either an inlet or exhaust port. When in the open position, the exhaust port 180 communicates with an exhaust header 182.

A detail of valve 138 (which may be either an inlet valve or an exhaust valve) is shown in FIG. 27. This valve 138 is similar in construction and operation to the valve shown in FIG. 24, and includes a shaft 186, head 188, spring 190, and tip 192. The spring 190 extends between the cap 192 and a collar 194, which is fixed relative to the valve 138. The valve slides between an open position, as shown in FIG. 27, in which the port 180 is open, and a closed position.

In operation, the valves of FIGS. 27 and 28 are oriented in a radially pattern on the valve block 132 shown in FIG. 24. Rotation of the stacked cam plate 120' with the shaft 116 causes the cams 162, 164 to contact the associated caps 170 of the inlet and outlet valves 138', 138", which are oriented in a radial pattern on the upper surface of the valve block 132. As the disks 120' rotate, the inlet and outlet valves 138 are sequentially actuated, opening and closing the inlet and exhaust ports associated with the cylinders 106 of the motor 10'.

A fourth embodiment of the invention is shown in FIGS. 29–35. In that embodiment, a rotary engine 10"' is shown which includes a bowl 198 having a cylindrical side wall 200 which includes an undulating top 202 and a flange 204 extending about the lower periphery. An interior floor 206 is included and extends within the cylindrical wall 200. A block 208 is positioned above the bowl 198 and includes a plurality of cylinders 210, each extending axially through the block.

As shown in FIGS. 30, 31, 32 and 33, the bottom wall 206 includes a peripheral groove 212 which is shaped to receive the lower edge 214 of the bowl 198 and includes an oil seal and bearing 216 which permits rotation of the bowl 198 relative to the bottom wall 206. The block 208 extends downwardly and receives a bearing 218 which is positioned between the block and the flange 204. Accordingly, the flange 204 supports the block 208 for relative rotation. The block 208 includes an inner wall 220 which extends downwardly and is concentric with the bowl 198 and cylindrical wall 200 and is attached to an annular boss 222 which is integral with the wall 206.

Figure 30:
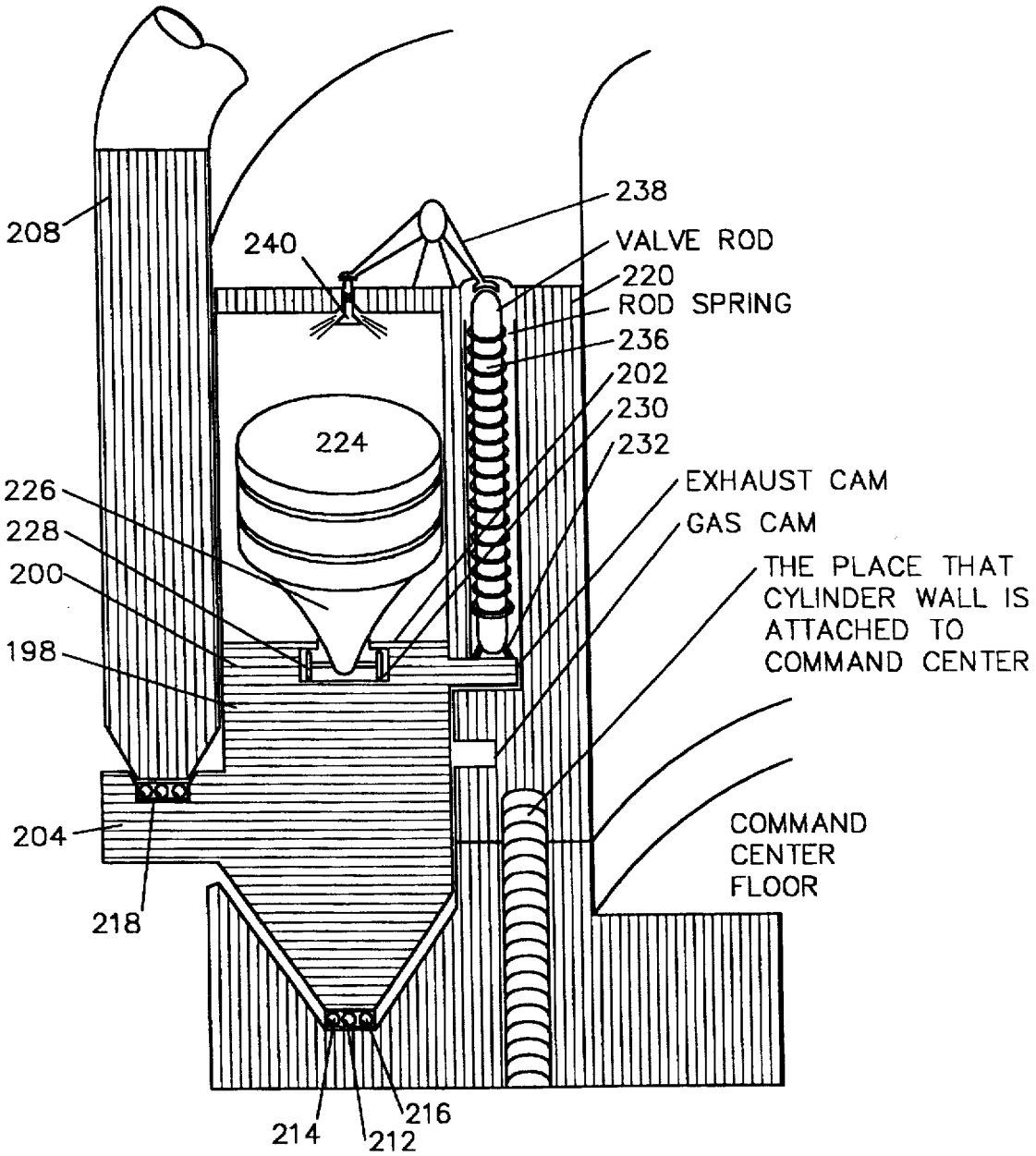
FIG. 30 is a detail showing the central cylindrical wall of the embodiment of FIG. 29.

As shown in FIG. 30, the pistons 224 include piston rods 226 which terminate in roller bearings 228 that are captured within a T-shaped slot 230 which is formed in the cylindrical wall 200 adjacent to the upper surface 202. In FIG. 29, an alternate embodiment of piston 224' is shown, in which the rod 226' is shown terminating in a cam 228' that rides along the upper, hardened surface 202 of the bowl 198.

Figure 31:
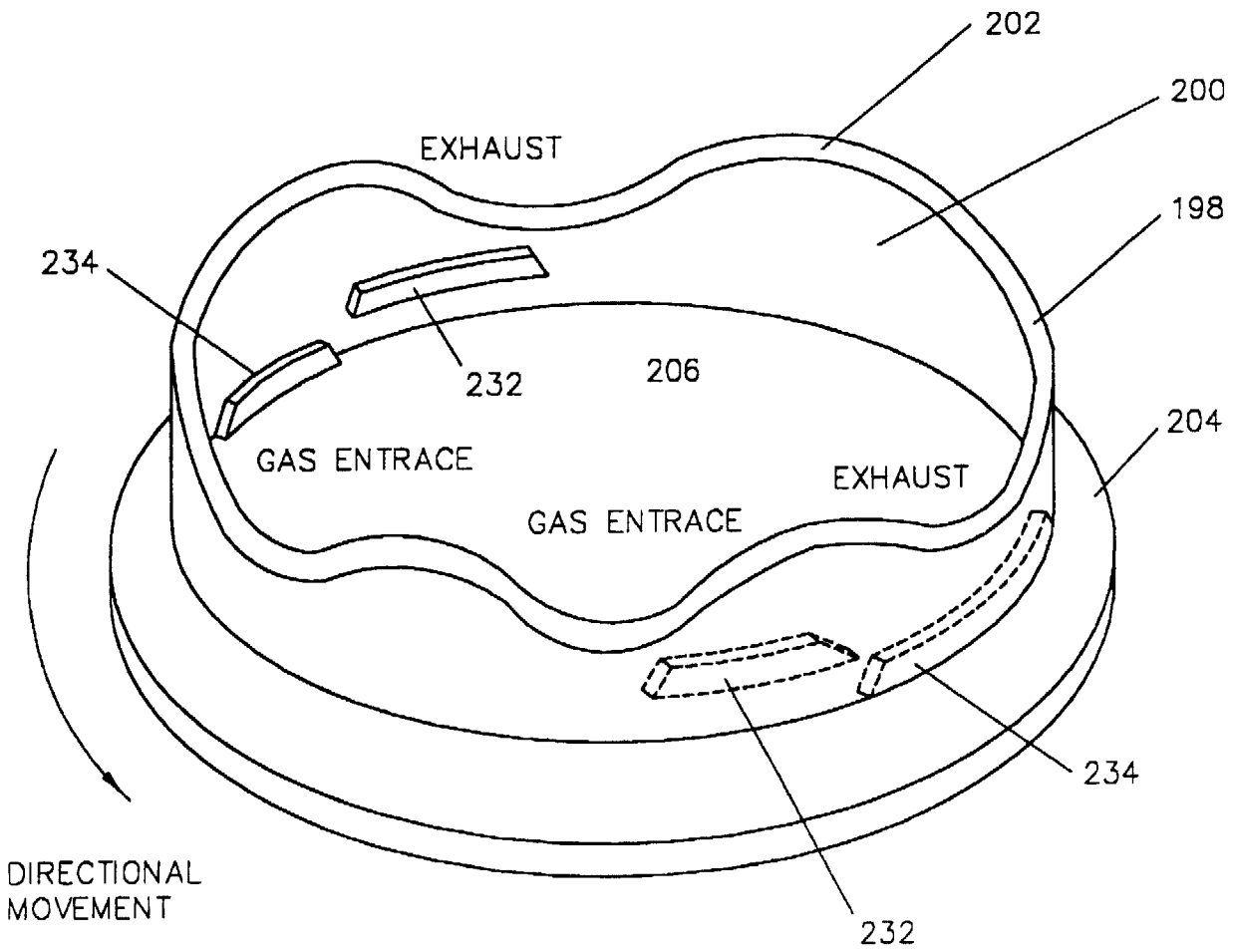
FIG. 31 is a detail, perspective view and partially in section of the embodiment of FIG. 29.
Figure 32:
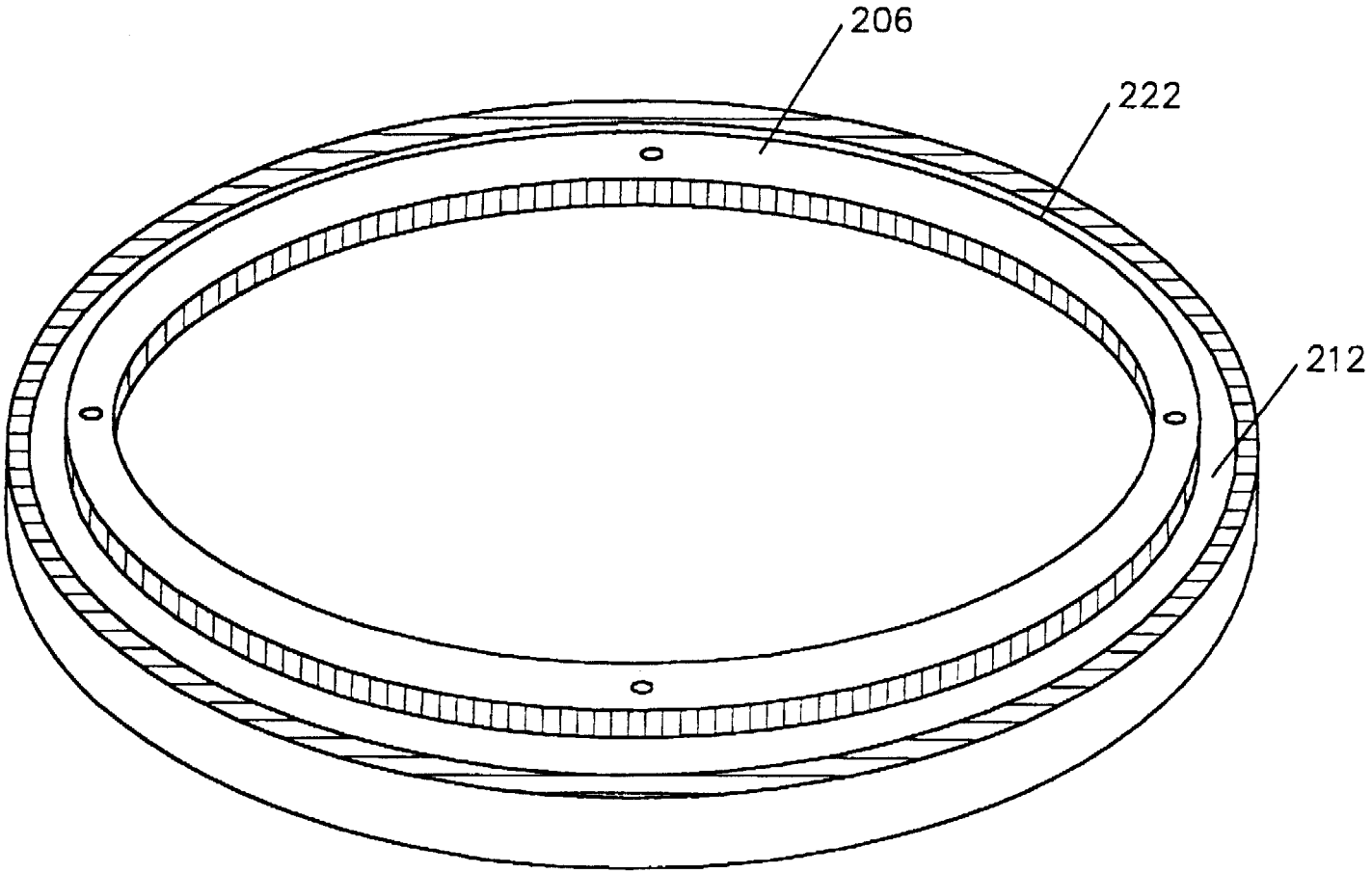
FIG. 32 is a perspective view of the bottom disk-shaped floor of the embodiment of FIG. 29.
Figure 33:
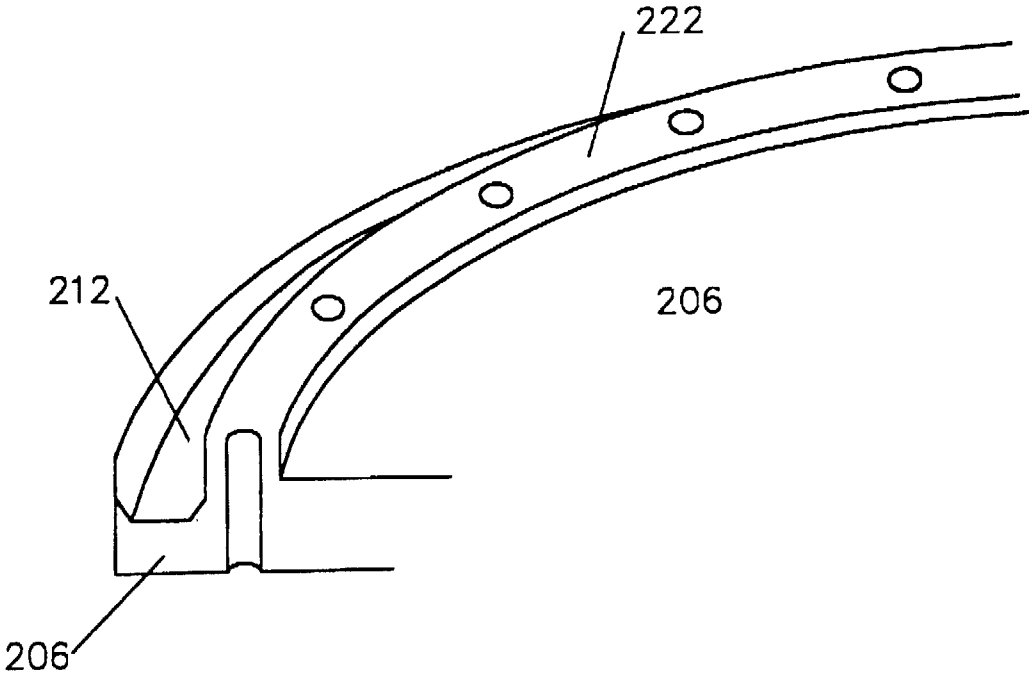
FIG. 33 is a detail of the disk of FIG. 32.

With the embodiment of FIGS. 31 and 33, the valve block is the same as shown in FIGS. 26, 26A, which allows fuel-air mixture to enter the cylinders 210, be combusted with spark plugs in the valve block, and be exhausted from the cylinders.

Figure 34:
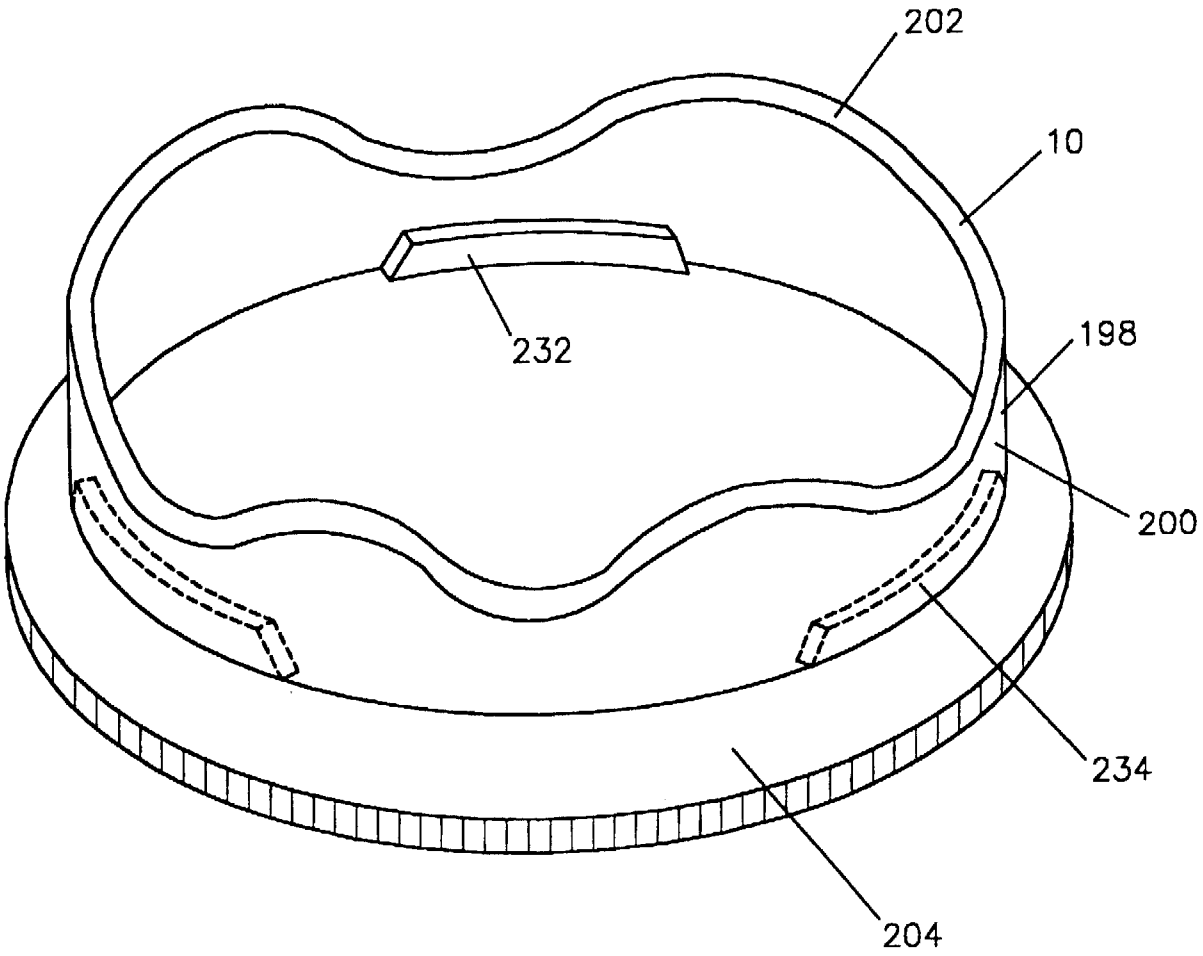
FIG. 34 is a perspective view of an alternate embodiment of the invention of FIG. 29.
Figure 35:
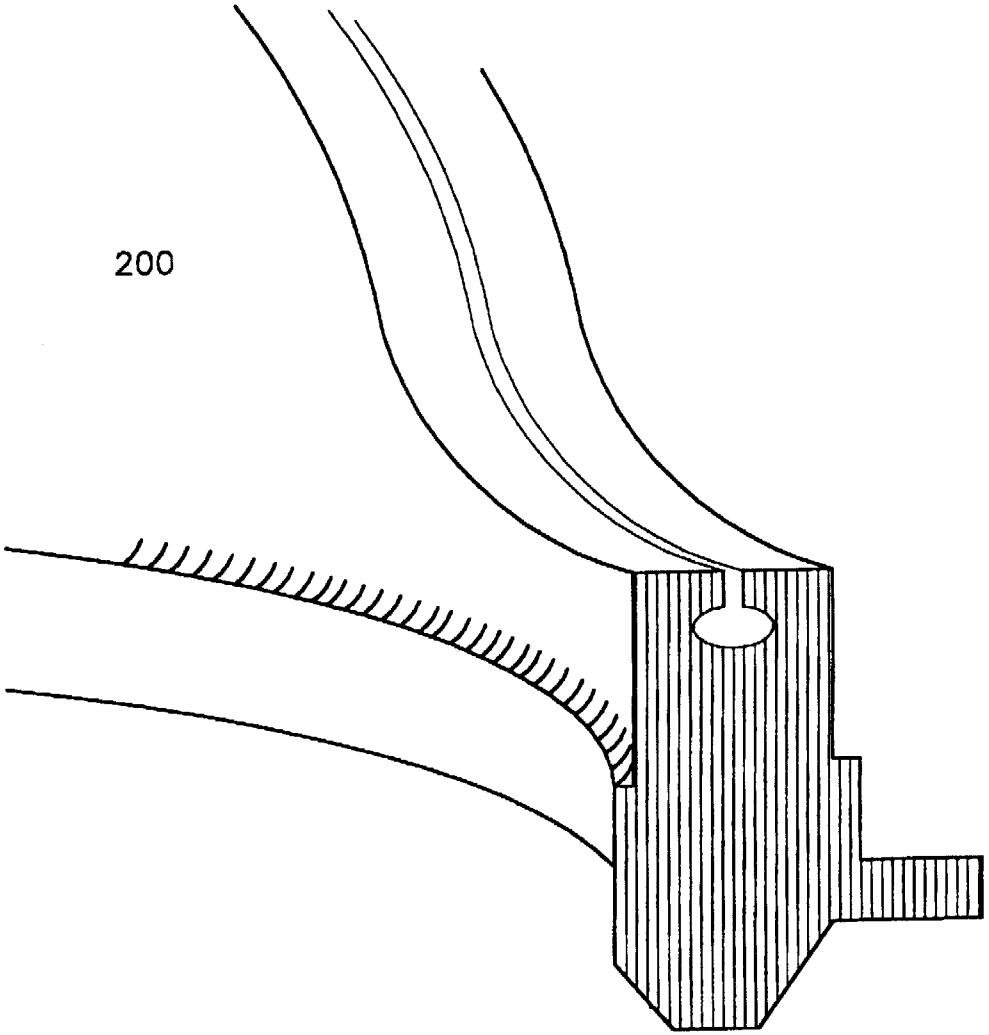
FIG. 35 is a detail of the embodiment of FIG. 34.

As shown in FIGS. 30, 31 and 34, the bowl 198 includes raised cams 232, 234 which are located radially inwardly and radially outwardly, respectively, of the cylindrical wall 200. Cams 232, 234 are shaped and spaced to contact conventional push rods (236) which in turn pivot rocker arms (238) that actuate conventional valves (240) to allow air to enter and exhaust from the cylinders 210.

The operation of the embodiment of FIGS. 29–35 is as follows. Fuel-air mixture is carbureted and enters the cylinders 210 of the block 208, where the mixture is combusted, thereby driving pistons 224, 224' downwardly against surface 202, or in the alternative, against T-slot 230. This downward motion causes the bowl 198 to rotate relative to the block 208 and attached floor 206. The rotation of the bowl can be used to generate propulsion, as by attaching propeller blades to the flange 204 to project radially outwardly like spokes of a wheel.

As with the earlier embodiments, a great deal of power can be generated with the designs discussed above. For example, if the engine has three cylinders and there are four undulations formed on the top of the bowl 198, with every revolution of the bowl, piston travel would occur 12 times of which 6 would be power strokes. Accordingly, the engine of the design of the present invention would have at least 3 times more power than a comparable, conventional engine.

Of course, if the number of cylinders are increased to 7 cylinders and the number of undulations increased to 8, then the combustion strokes are correspondingly increased, to 28 per rotation of the bowl 198. Also, with the embodiment of FIGS. 29–35, the bottom wall 206 within the block 208 can serve as a command center. Accordingly, the number of power strokes per revolution is as follows:

$$\frac{N_{[undulations]} \times N_{[pistons]}}{2} = N_{[power\ strokes]}$$

It is preferable to have an odd number of pistons so that the pistons do not all engage in a power stroke at the same time. An even number of undulations is required so that inlet and exhaust cycles are provided for each piston by cams.

While the forms of apparatus herein described constitute preferred embodiments of this invention, it is to be understood that the invention is not limited to these precise forms of apparatus, and that changes may be made therein without departing from the scope of the invention.

What is claimed is:

1. A rotary engine comprising:

a central rotor having a peripheral cam surface, said cam surface having a plurality of radially extending noses, each of said noses having a generally concave leading cam surface and a generally convex trailing surface, said central rotor having a central output shaft;

an annular stator positioned radially outwardly of and concentric with said rotor, said stator having an annular wall and a plurality of V-shaped blades pivotally mounted in said wall;

each of said blades including a radially inner plate having an end surface shaped to engage said cam surface, a radially outer plate, and a cylindrical pivot body positioned at a vertex of said blades said body having a passageway connecting an outer surface of said outer plate to an outer surface of said inner plate, said passageway having a valve oriented to prevent fluid flow from said inner plate to said outer plate;

said annular wall having a plurality of wedge-shaped chambers positioned such that each of said chambers encloses one of said outer plates, said chamber having an outer wall with an air inlet port and a check valve in said port which prevents fluid flow out of said chamber, and a plurality of concave combustion surfaces, each of said combustion surfaces being positioned adjacent to one of said chambers and to one of said inner plates and including a spark plug;

an outer cylinder shaped to enclose said stator and rotor;

a pair of end plates mounted on said outer cylinder, one of said end plates including air intake ports for supplying air and fuel to said chambers;

whereby rotation of said rotor relative to said stator causes said cam surface to bear against said end of said V-shaped blade and pivot said blade relative to said stator, thereby causing said outer plate to compress a fuel air mixture in said chamber and force said compressed mixture through said channels to a space between said inner plate and said combustion surface where said mixture is ignited by said spark plug, thereby forcing said V-blade to pivot against said convex trailing cam surface and rotate said rotor relative to said stator.

2. The rotary engine of claim 1 further comprising an ignition switch for actuating said spark plug, said switch being mounted on said stator and positioned to contact said nose of said cam surface.

3. The rotary engine of claim 1 wherein said pivot bodies are journaled into said end plates, said end plates including upper and lower end caps, and said valves including each of said end caps having passages positioned to communicate with said passageways in said pivot body to allow a fuel-air mixture to enter said combustion chamber, then said pivot body passageway pivots out of communication with said end cap passageway as said blade pivots in response to ignition of said fuel-air mixture in said combustion chamber.

4. The rotary engine of claim 3 wherein said pivot bodies are oriented parallel to a central axis of said rotor.

5. The rotary engine of claim 4 wherein said inner plate is shaped to cover and seal against said combustion surface.

* * * * *